US010435849B2

(12) United States Patent
Tusino et al.

(10) Patent No.: US 10,435,849 B2
(45) Date of Patent: Oct. 8, 2019

(54) MODULAR SYSTEM FOR THE LAYING OF UNDERGROUND AND RAILROAD AND TRAM LINES

(71) Applicant: Vianini S.p.A., Rome (IT)

(72) Inventors: Elvidio Tusino, Rome (IT); Fernando Ripesi, Rome (IT)

( * ) Notice: Subject to any disclaimer, the term of this patent is extended or adjusted under 35 U.S.C. 154(b) by 0 days.

(21) Appl. No.: 15/549,662

(22) PCT Filed: Feb. 10, 2015

(86) PCT No.: PCT/IT2015/000029

§ 371 (c)(1),
(2) Date: Aug. 8, 2017

(87) PCT Pub. No.: WO2016/129001

PCT Pub. Date: Aug. 18, 2016

(65) Prior Publication Data

US 2018/0023258 A1 Jan. 25, 2018

(51) Int. Cl.

| | |
|---|---|
| ***E01B 9/66*** | (2006.01) |
| ***E01B 1/00*** | (2006.01) |
| ***E01B 19/00*** | (2006.01) |
| ***E01B 3/30*** | (2006.01) |
| ***E01B 3/40*** | (2006.01) |

(52) U.S. Cl.
CPC ..... *E01B 9/66* (2013.01); *E01B 1/002* (2013.01); *E01B 3/30* (2013.01); *E01B 3/40* (2013.01); *E01B 19/00* (2013.01)

(58) Field of Classification Search
CPC ... E01B 9/66; E01B 1/00; E01B 1/002; E01B 3/30; E01B 3/40; E01B 19/00
See application file for complete search history.

(56) References Cited

U.S. PATENT DOCUMENTS

| | | | | |
|---|---|---|---|---|
| 6,913,717 | B2 * | 7/2005 | Sayadi | E01B 1/002 238/5 |
| 7,891,576 | B2 * | 2/2011 | Bogl | E01B 1/002 238/2 |
| 2004/0182946 | A1 * | 9/2004 | Reichel | E01B 1/004 238/5 |
| 2011/0278366 | A1 * | 11/2011 | Andre | E01B 25/28 238/5 |
| 2018/0023258 | A1 * | 1/2018 | Tusino | E01B 1/002 238/174 |

* cited by examiner

*Primary Examiner* — Jason C Smith

(57) ABSTRACT

A module (100) for a system for the laying of underground and railroad and tram lines both in tunnel and on the surface, in particular railroad and tram lines, comprising a supporting slab (101) for the tracks (6), with substantially parallelepiped shape, the slab having at least four peripheral housings (1), passing from the extrados to the intrados and suitable to house respective adjustable levelling devices (120).

18 Claims, 22 Drawing Sheets

MODULAR SYSTEM FOR THE LAYING OF UNDERGROUND AND RAILROAD AND TRAM LINES

FIELD OF APPLICATION

The present invention relates to a system for the laying of railroad and tram lines both in tunnels and on the surface. In particular, the proposed system has important evolutions of the anti-vibrating equipment systems with prefabricated floating, and not, basins÷slabs.

Hereinafter in the description, under the term "railroad and tram line" an underground, railroad or tram line will have to be meant indistinctly.

Systems of Known Art and Disadvantages Thereof

The systems of known art with prefabricated—floating and not, anti-vibrating and not—basins-slabs provide the laying of manufactured products made of ordinary or pre-compressed concrete with important weight-mass.

These manufactured products are then laid on continuous or discrete supports involving the intrados of the basins-slabs.

In case of discrete supports (used only for the anti-vibrating floating solutions) the laying of the basins-slabs and of the elastomeric discrete supports take place dry without the possibility of altimetric adjustments (needed in relation to the inevitable irregularities in constructing the floor laying). Altimetric (and planimetric) adjustments of the top of rail are then guaranteed in a second phase for the laying—by using laying bedding mortars-grouts—of sleepers (single-block, two-block with or without gauge spacer, made of cap, cao, wood, plastics, iron, equipped, or not, with elastomeric plates of sleeper-pad and rubber boots) housed in compartments existing in extrados to the basins-slabs.

There are even solutions providing the use of direct fastening systems implemented upon laying providing altimetric adjustments by means of laying bedding mortars-grouts placed below the equipment metallic plate (solutions by the way used even for not prefabricated solutions).

In case of continuous supports (mainly used for the not floating and not anti-vibrating solutions) the laying of the basins-slabs (and in case of the elastomeric continuous supports) takes place with the laying of bedding mortars-grouts in opera in intrados to the just mentioned manufactured products, with possibility of altimetric adjustments (needed in relation to the inevitable irregularities in constructing the floor laying). In these cases often one avoids using sleepers, the basins-slabs being equipped in extrados with shapes and inserts for installing the fastening systems of the rails.

Generally these systems are equipped with stopper (with different positions and types) which have the purpose of contrasting with the (both transversal and longitudinal) loads in the track plane. These components—in case of the floating and anti-vibrating solutions—should not prevent the free vertical motion of the basins-slabs (floating freedom of the basins-slabs). The most used position is that in axis to the (central) track, in this case the stopper has not an adequate cross and longitudinal deformability. Less frequently—solutions are used with laying of stopper made of steel-rubber on the flanks of the (side) basins-slabs, which are equipped with adequate vertical, cross and longitudinal deformabilities.

The most significant disadvantages of the systems of known art with the just-described prefabricated basins-slab can be summarized as follows:

- For the discrete solutions the altimetric adjustment during laying is extremely reduced [from minimum adjustments in the order of (−5)÷(+10) mm to maximum adjustments in the order of (−20)÷(+20) mm] and then often not compatible with the usual techniques for constructing the floor laying. This aspect involves both the use of more expensive constructing solutions of the floor laying, and the presence of several construction non-conformances to be removed during laying (with costs and time which not always can be pre-defined and compatible with the infrastructure construction).
- For the continuous solutions—even in presence of adequate levels of altimetric adjustment—the use of important volumes of mortars-grouts involves both high costs and time, and the use of components (mortars-grouts) which often—if not properly selected and tested (reasonably feasible for reduced volumes)—have shown deteriorations in time not compatible with the useful commercial life of the track. Furthermore—in case of high thicknesses of the mortars-grouts—the use of reinforcing electro-welded networks is requested.
- The use of the side stoppers, in some lay-out of the line, has space problems not always easy to be solved.
- The use of the central stoppers has problems of not adequate elasticity in the (longitudinal and cross) track plane not compatible with the anti-vibrating performances of the floating systems.
- The use of continuous elastomeric manufactured products do not allow possible replacements of the operating component during the useful commercial life of the equipment; condition which—with suitable devices—is allowed in case of using discrete elastomeric manufactured products.
- In many solutions of known art there is the presence of elastomeric components characterized by high values in the dynamic stiffenings (meant as relationship between the static stiffness—mobilized by the gravitational loads moving along the track—and the dynamic stiffness—mobilized by the dynamic phenomena of interaction track÷vehicle and contact wheel÷rail), the reduction thereof would guarantee better performances of the rail system (both in terms of yieldings of the top of rail, and the capabilities of dampening the vibrations).
- The construction time often is not compatible with the construction and/or renewal programmes; it appears necessary to reduce to the minimum the laying procedures, by privileging the prefabrication and the pre-assemblies in the factory or outside the line.

EP1783275 refers to a floating slab, having a main body supported—in use—by springs. The slab is floating and therefore is not in contact with the ground and all the load is carried by the springs.

The seats of the springs are cylindrical and passes from the intrados to the extrados. Shims are used for adjusting the height and/or the inclination of the slab with respect to the ground.

WO2011/038612 discloses a suspension system for slabs. According to such disclosure, the slab has peripheral housings wherein suspension members are placed. Shims are used for adjusting the height and/or the inclination of the slab with respect to the ground. The housings are realized at the very extreme periphery of the slab and they are opened at the sides of the slabs. The shims are inserted from side openings of the housings.

SUMMARY OF THE INVENTION

The object of the present invention is then to solve the problems not solved so far in the known art, by providing a modular system for the laying of tracks for railroad and tram lines. This is obtained by means of a module as defined in claim 1 and a system as defined in claim 20.

Additional features of the present invention are defined in the depending claims.

The present invention, by overcoming the problems of known art, involves several and evident advantages.

In particular, the present invention allows the laying of tracks for railroad and tram lines.

Conceptually the railroad and tram solutions are wholly analogous to the underground ones for the operating scheme, assembly mode and type of the used components. The sizes of some components, the masses of the massive floating masses and the pitch of the track resting mechanism change which vary from 750 mm for the underground and tram solution up to 600 mm for the railroad solution.

Furthermore, the system according to the present invention can be installed on any subsoil of the railroad and tram line, in terms of lay-out (see straight stretches and curves with possible superelevation of the outer rail) and in terms of infrastructure (see tunnel, cutting, satin, embankment, viaduct).

The system—previous suitable sizes and choices of the single components described hereinafter and both within the floating, and not, solutions—is able to adequate to any operating condition, passing from the solutions for trams and undergrounds (loads per axis 100÷130 kN/axis; speed 60÷120 km/h), to the solutions for railroads at high speed (loads per axis 160÷180 kN/axis; speed 300÷350 km/h), to the solutions for railroad lines existing in Europe (loads per axis up to 250 kN/axis; speed 100÷130 km/h), to the solutions for railroad lines existing outside Europe (loads per axis up to 350 kN/axis; speed 100÷130 km/h).

Other advantages together with the features and the use modes of the present invention will result evident from the following detailed description of preferred embodiments thereof, shown by way of example and not for limitative purpose.

The figures of the enclosed drawings will be referred to, wherein.

DETAILED DESCRIPTION OF EMBODIMENTS OF THE INVENTION

Figure 1:
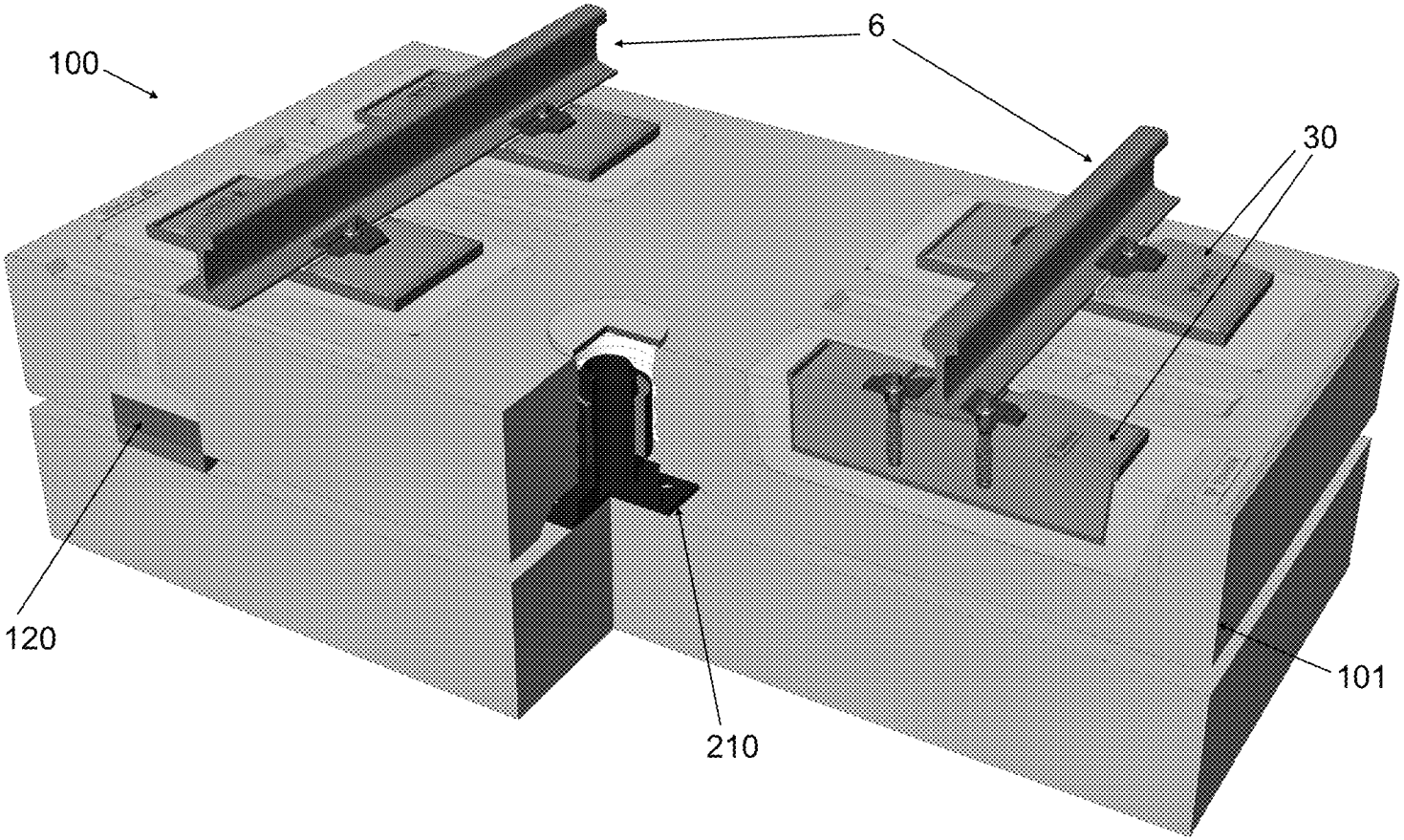
FIG. 1 is an exemplifying, partially cut-away view, of a module according to the present invention.

By referring to FIG. 1 this shows, by way of example and schematically, a module 100 according to the present invention.

Such module 100 first of all comprises a supporting slab 101 for the rails 6.

The floating, and not, slab (or basin) 101, preferably prefabricated, is the main component of the system and preferably is made of concrete with loose reinforcement, but under certain conditions precompressed manufactured products, even with pre-tightened/post-tightened reinforcement, are provided.

Advantageously, from an operating point of view, the concrete is cast in the caissons so that while the extrados and the side faces result to be smooth made of concrete with metallic caisson bottom, the intrados is smoothed with plaster trowel.

The slab 101 constitutes the system mass relatively to the main vibrating way of the equipment system.

The slab 101 has a substantially parallelepiped shape and, even if not necessarily, preferably has one or more pairs of housings with prismatic basin 3, implemented in extrados, apt to house respective rail-bearing blocks (30).

Figure 2:
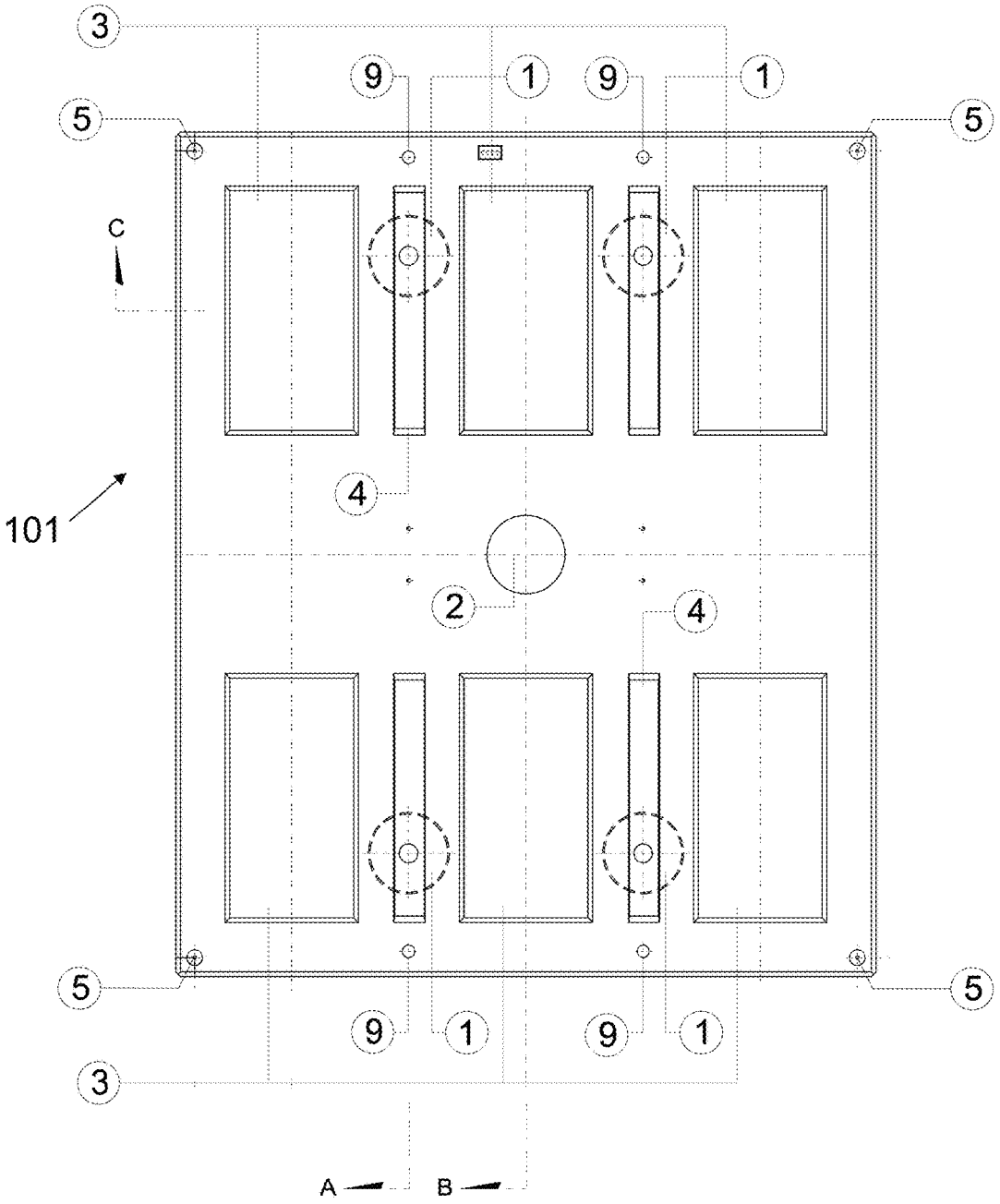
FIGS. 2 to 6 are views of a slab of a module according to the present invention.
Figure 3:
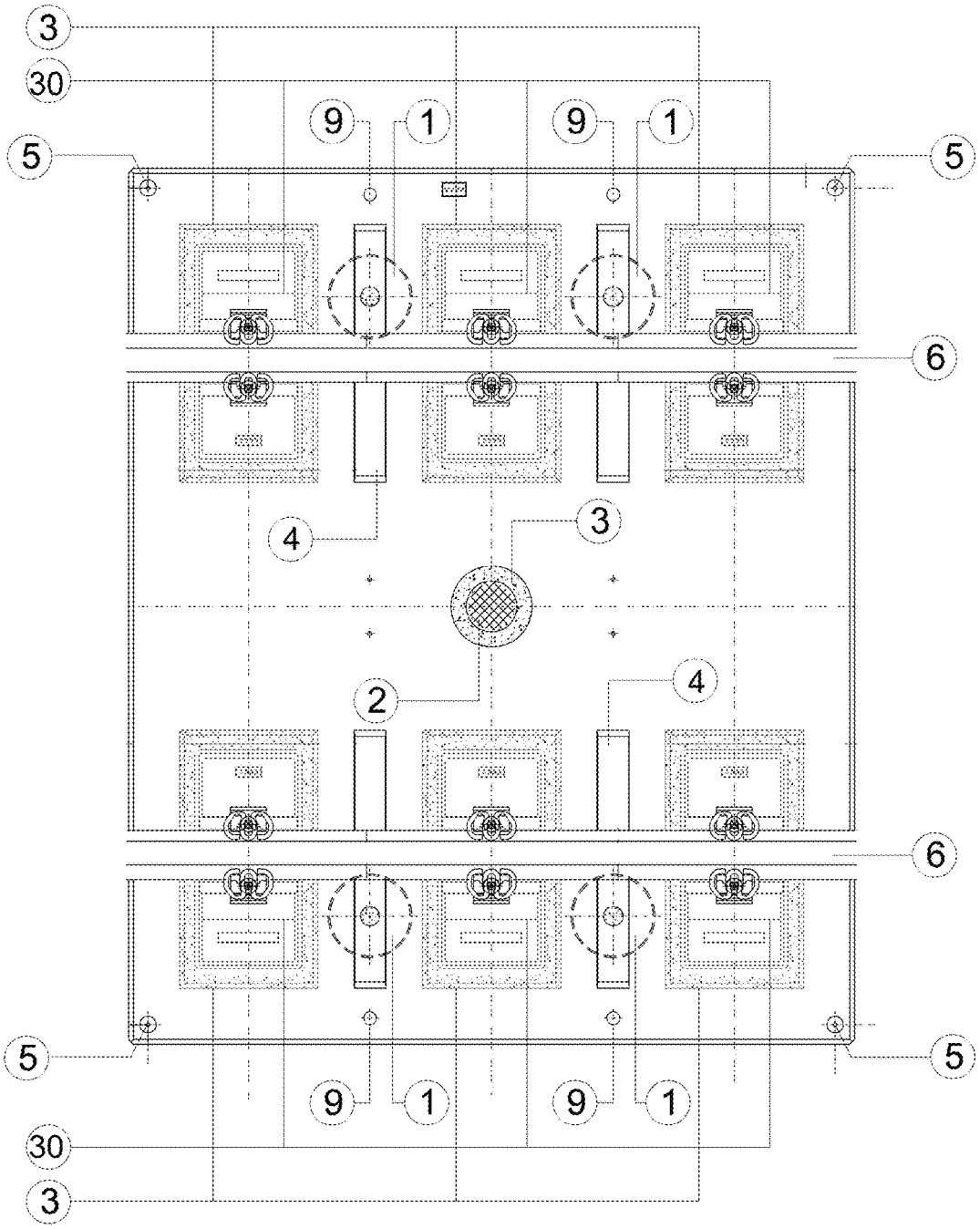
Figure 4:
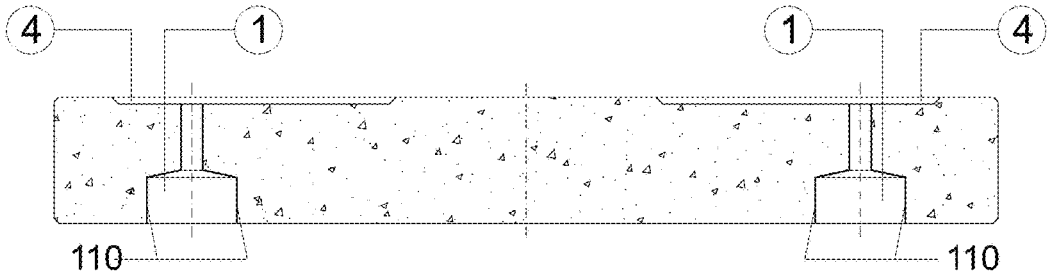
Figure 5:
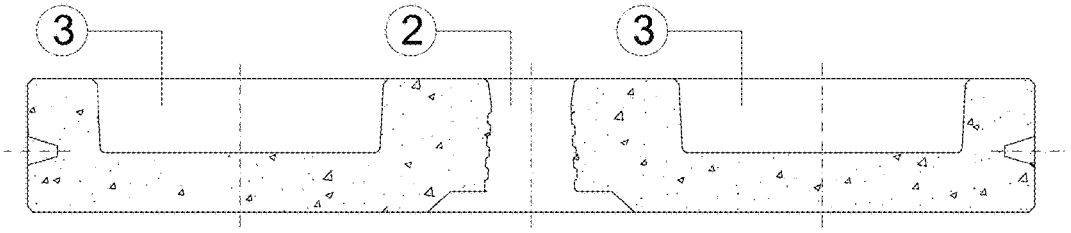
Figure 6:
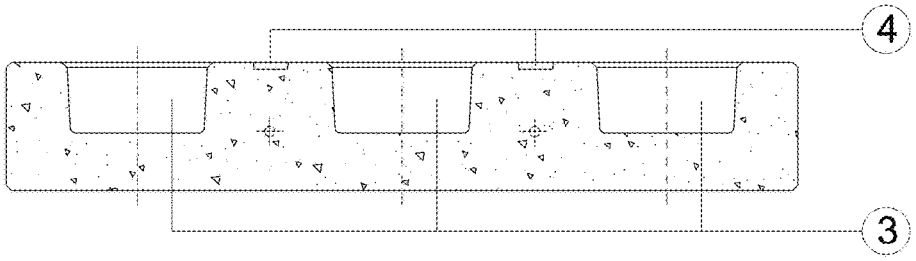

The subsequent FIGS. 2 and 3 are top plan views of a slab 101 according to the present invention, whereas the FIGS. 4, 5 and 6 are section views of the slab 101, taken along the lines A, B e C of FIG. 2, respectively.

The slab 101 comprises at least four peripheral housings 1, (for the railroad six) passing from the extrados to the intrados, apt to house respective adjustable levelling devices.

Preferably, the prefabricated slab 101 provides three (four or more) pairs of housings with prismatic basin 3 and then implements three (four or more) resting members for each rail and represents a repetitive module of the system which, according to the currently used standards, has a length equal to:

For the solution Underground—750 mm×3=2,250 mm

For the solution Railroad—600 mm×3=1,800 mm, or 600 mm×4=2,400 mm

Since the cross size preferably is variable from 2,400 mm to 3000 mm in relation to the type of railroad-tram use, the just exposed longitudinal sizes are compatible for conventional transports both on rubber, and on railroad (with reference to a limit shape of 2,500 mm). If there should not be limits linked to overall dimensions for the transportation and one should have available adequate lifting means, the slab could have larger sizes and such housing pairs could be in higher quantity.

The slab 101 then has reduced sizes and relative poor weight so as to allow the transportation, motion and laying thereof with means and ordinary equipment both on the road and on railroad and in the building site. The manufactured product is reliable as to the quality of the implementation, the performances and the duration in time.

However, it is possible varying the geometry of the slab 101 without relevant difficulties or economical burdens, so as to be able to better satisfy specific requirements which are met in the equipment applications (see for example particular geometries such as curved lay-outs, tunnel shapes and viaducts). Thicknesses and mass of the slab 101 in particular are linked to the line features (load per axis, speed of the trains, overall dimensions compatible with the lay-out of the line, lay-out, etc.) determining the use of the single loose reinforcement (more frequent) or the need of using even pre-tightened/post-tightened reinforcements (less frequent, but needed in case of not floating slabs with reduced thicknesses).

As it is visible in FIG. 4, each one of said peripheral housings 1 has a portion at the intrados with prismatic shape, having a first base area and a portion at the extrados having a second base area, the second area being smaller than the first area.

Figure 7:
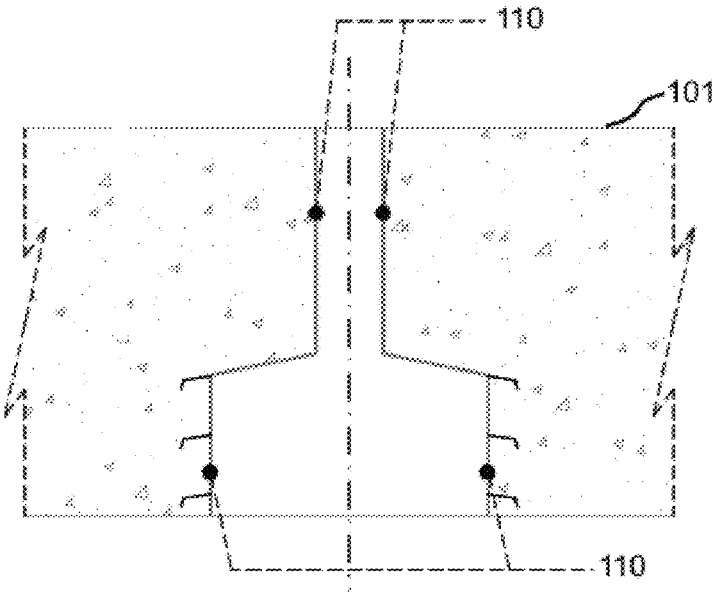
FIGS. 7 to 12 are view of a levelling member according to the present invention.
Figure 8:
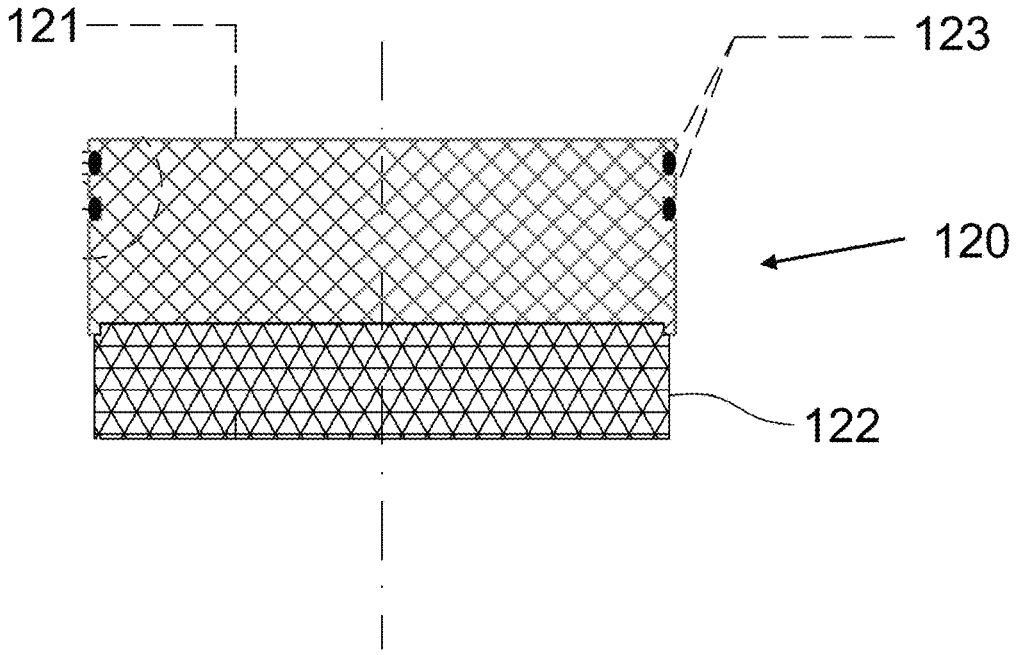
Figure 9:
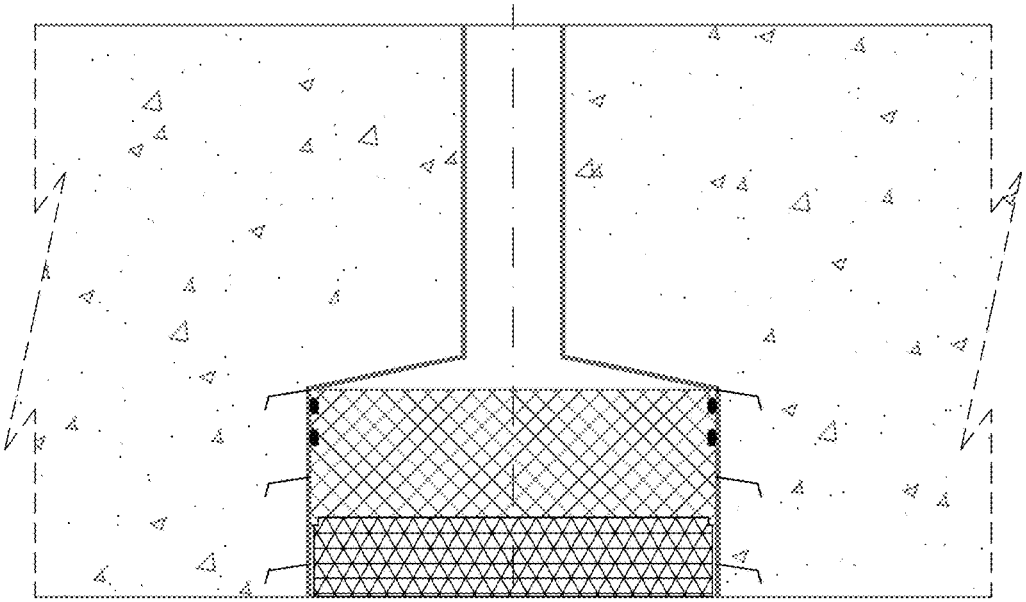
Figure 10:
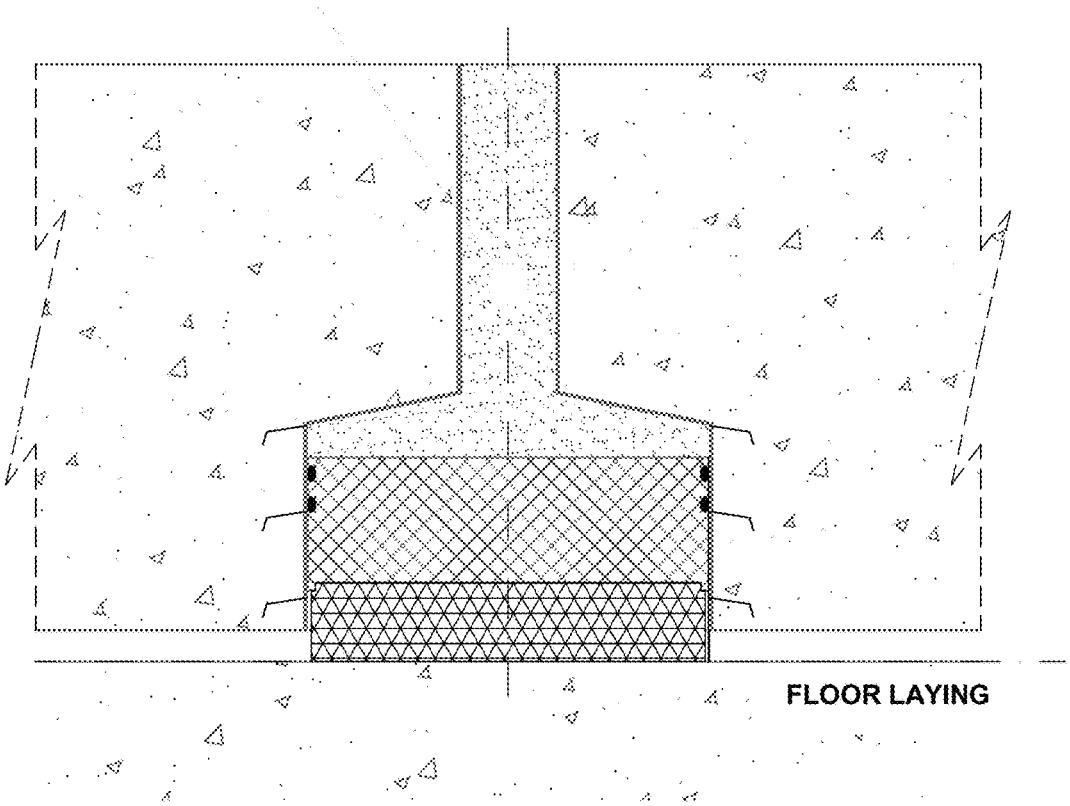
Figure 11:
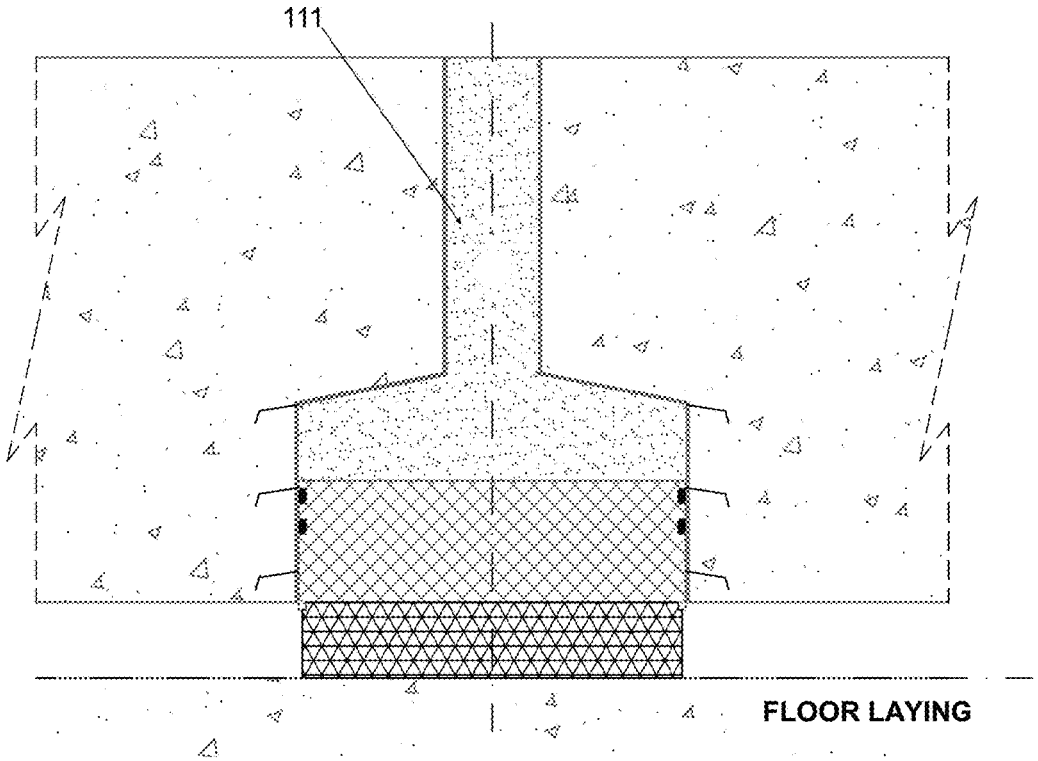

The subsequent FIG. 7 is a section view of a greater detail of one of such peripheral housings 1.

Preferably, each one of the peripheral housings 1 comprises a jacket 110, for example made of PVC/PE or other suitable material such as for example metal, properly anchored to the body of the slab 101 during the prefabrication phase. The jacket 110 then plays even the function of a disposable caisson during the implementation of the manufactured product. By way of example, herein a caisson with circular section is described, with diameter variable between the intrados and the extrados. In particular it is constituted by two cylindrical portions joined therebetween by a truncated conical section. However, it is to be meant that other sections can be provided.

Inside the jacket 110, in particular within the portion at the intrados, a corresponding levelling device 120 could be placed. The levelling device is slidingly assembled, so as to be able to be moved along the longitudinal axis of the prismatic portion.

Advantageously, the levelling member 120 comprises a sliding member 121 and a supporting member 122, overlapped therebetween.

By way of example, the sliding member 121 is made of PVC/PE or other suitable material, whereas the supporting member 122 is made of elastomeric material.

As it will be clearer hereinafter in the description, such levelling devices 120 perform some important functions during the laying and the operation of the system according to the present invention.

During the phase of laying the slab, the levelling devices 120 make possible to adjust the resting of the slab within a margin of at least ±30 mm. This is shown by way of example in FIGS. 9 to 12.

In fact, the levelling device 120 can slide in vertical direction inside the cylindrical jacket and project more or less from the slab with respect to the floor laying, being able then to compensate possible lacks of homogeneity of the floor laying itself.

After having positioned with millimetric precision the slab in planimetric and altimetric terms, the levelling devices 120 are pushed, from the extrados to the slab, as far as they find the contact with the floor laying. At this point from the extrados of the slab bedding mortar/grout 111 can be cast which clogs completely the housing 1 upon the levelling device, by implementing—for each slab stable resting members as they match with the lay-out of the plan rail and the geometrical conditions of the floor laying (see irregularity, not planarity, etc.).

Furthermore, during the operation phase, once the installation is completed, each slab is supported by four or more elastomeric supporting members 122 allowing the manufactured product made of concrete to float, by implementing the "mass÷spring" system, wherein the mass is represented by the slab and the spring is the portion made of elastomer of the supporting members 122.

Advantageously, it can be provided that the levelling devices 120 comprise seals 123 arranged in corresponding seats implemented on the periphery of the sliding members 121. Such seals have two functions:

- The first one relates to the phase of moving the slab from the factory to the building site and inside the building site; in fact the manufactured product made of concrete is supplied to the building site already equipped with the four levelling devices 120; they find their natural housing in the cylindrical compartments existing in the slabs. The seals 123 are able to keep in position the levelling devices 120.
- The second one relates to the clogging phase in extrados of the compartments housing the levelling devices 120 with bedding mortar/grout. The seals 123 are able to guarantee the sealing between compartment and manufactured product, by avoiding seepings of the fluid mortar/grout towards the floor laying.

Figure 12:
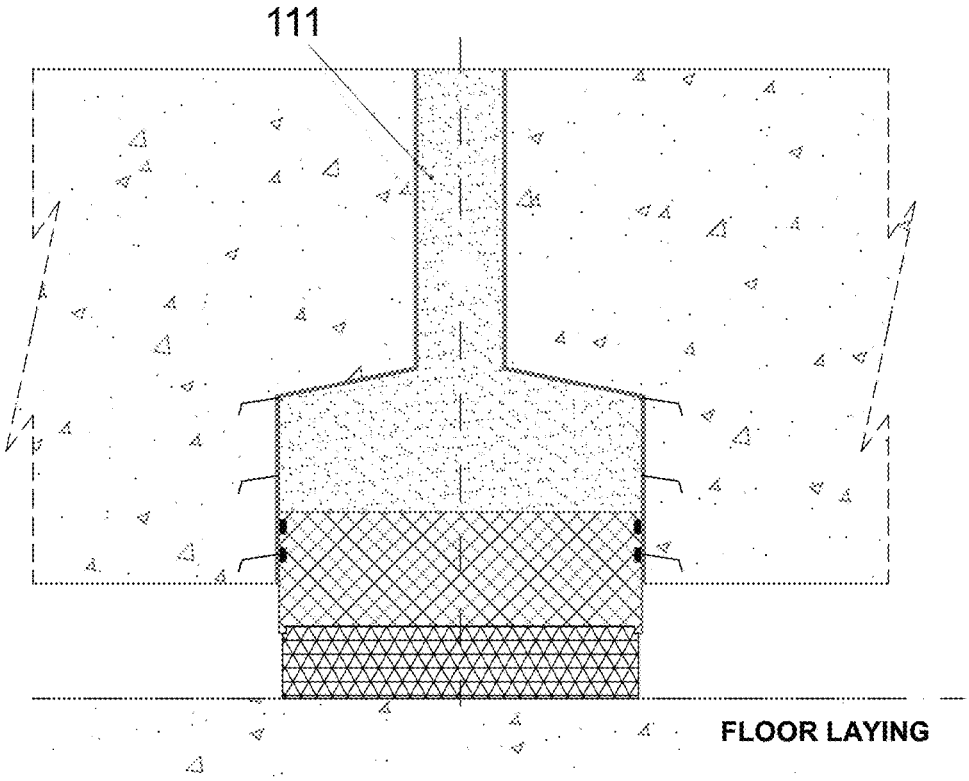
Figure 12A:
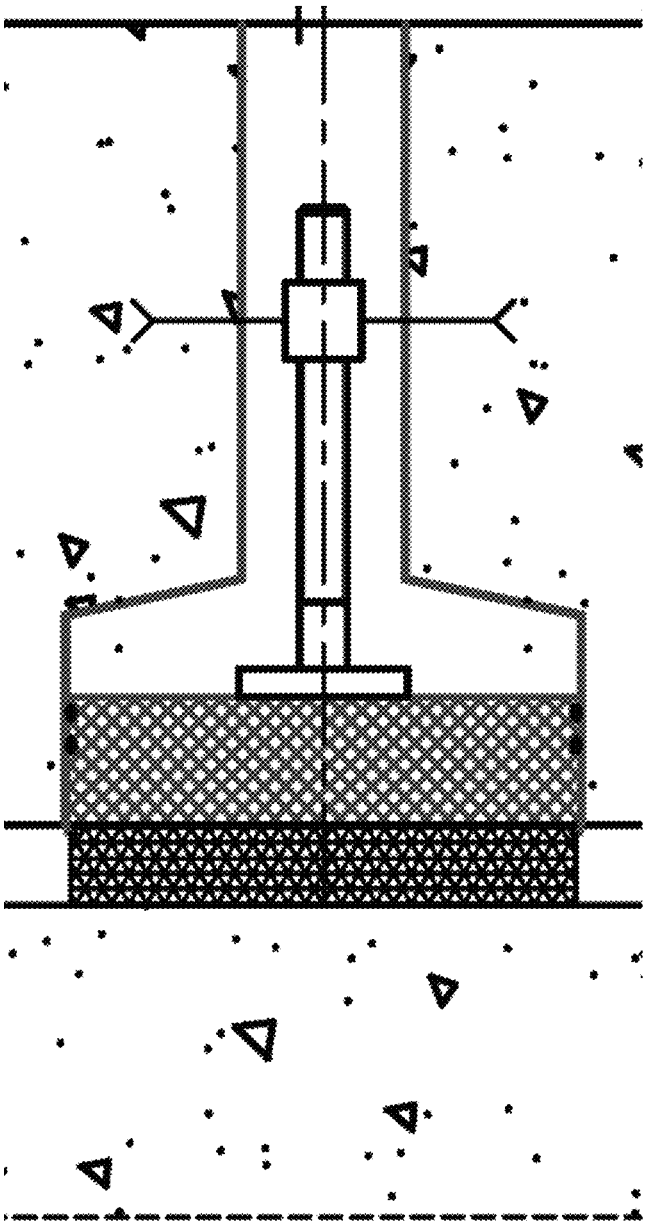
FIG. 12A is a section view of a variant of a levelling member, even having a lifting jack.

Advantageously, as illustrated by way of example in FIG. 12A, each one of the housings for the levelling devices 120, can comprise, already pre-arranged, a jack implemented by means of a bushing 33 whereon a threaded bar 34 is screwn. The bar 34, by means of a buffer 35, rests upon the sliding member 121. By acting then on the threaded bar it is possible bringing the supporting member 122 in contact with the floor laying and adjusting the height of the slab. Then, once adjusted, the housing could be filled up with mortar as already described.

Such configuration has the advantage that the resting of the supporting member 122 on the floor laying takes place under the load of the same slab, by guaranteeing then an optimum contact.

Furthermore, the presence of the jack allows a more comfortable and quick implementation, as it is possible positioning definitely the slab, casting the mortar and leaving then that this sets quickly, in the meantime laying one of more subsequent slabs.

Figure 13:
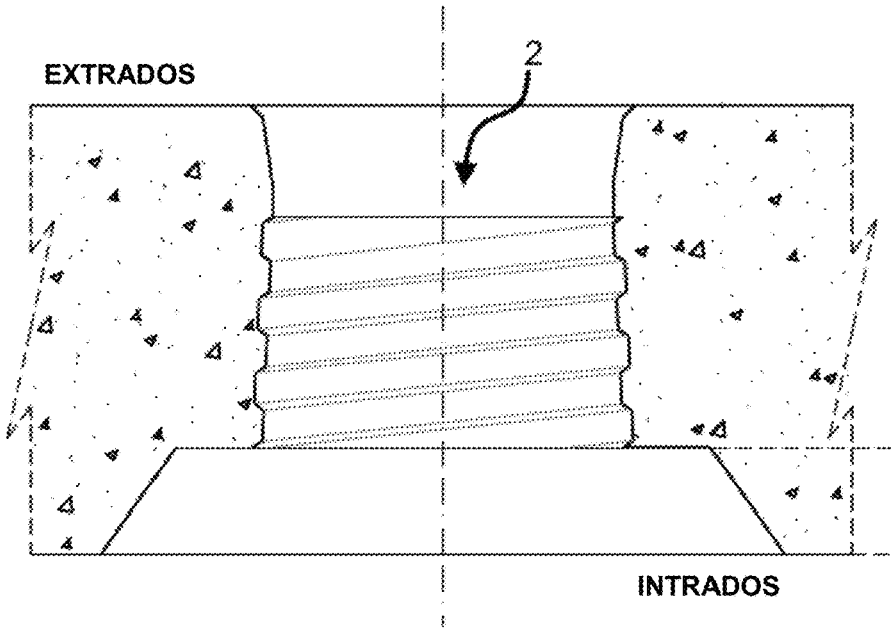
FIGS. 13 to 18 are view of a member for stabilizing to the longitudinal and cross loads according to the present invention.

According to an embodiment, the slab 101 can have a central housing 2, passing from the extrados to the intrados, apt to receive a stabilizing member 200 of the supporting slab 101. A detail view of such housing is shown in FIG. 13.

Figure 17:
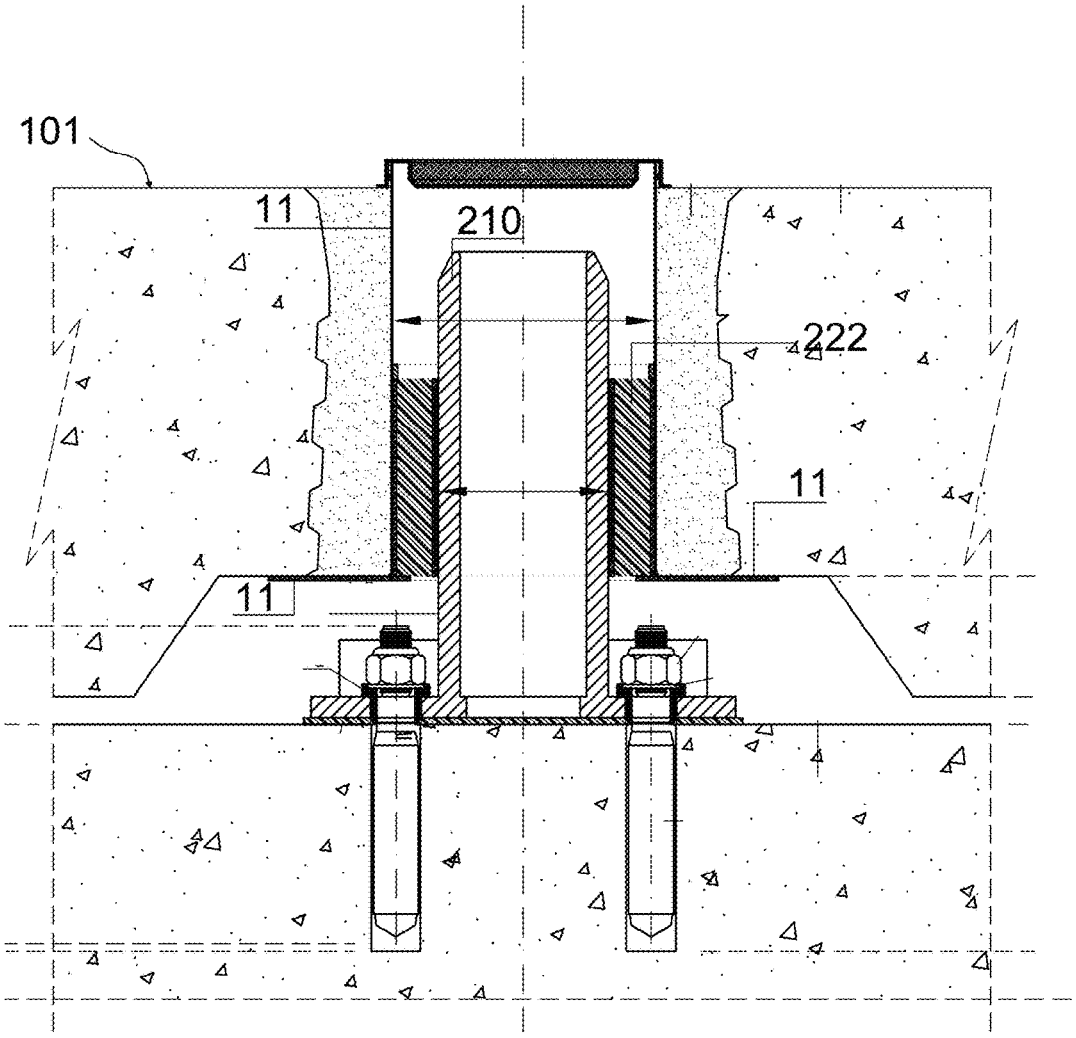

In fact, in the laying, for some modules a stabilizing member 200 of FIG. 17 of the supporting slab 101 is provided. Such stabilizing member 200 has the function of contrasting the horizontal actions generated on the equipment by the train snaking, by the accelerations and brakings and by the centrifugal forces produced during the passage in curve.

Number and frequency of the stabilizing members 200 should be determined based upon the specific needs. Experimental and theoretical tests, carried out by considering different underground and railroad trains, have shown that usually it is necessary installing a stabilizing member 200 every ⅔ modules; in particular cases (extremely reduced radii of curvature, considerably variable transit speed of trains in curve, exceptional loads per axis etc.) it can be necessary to install one or more stabilizing members 200 in each module.

Figure 14:
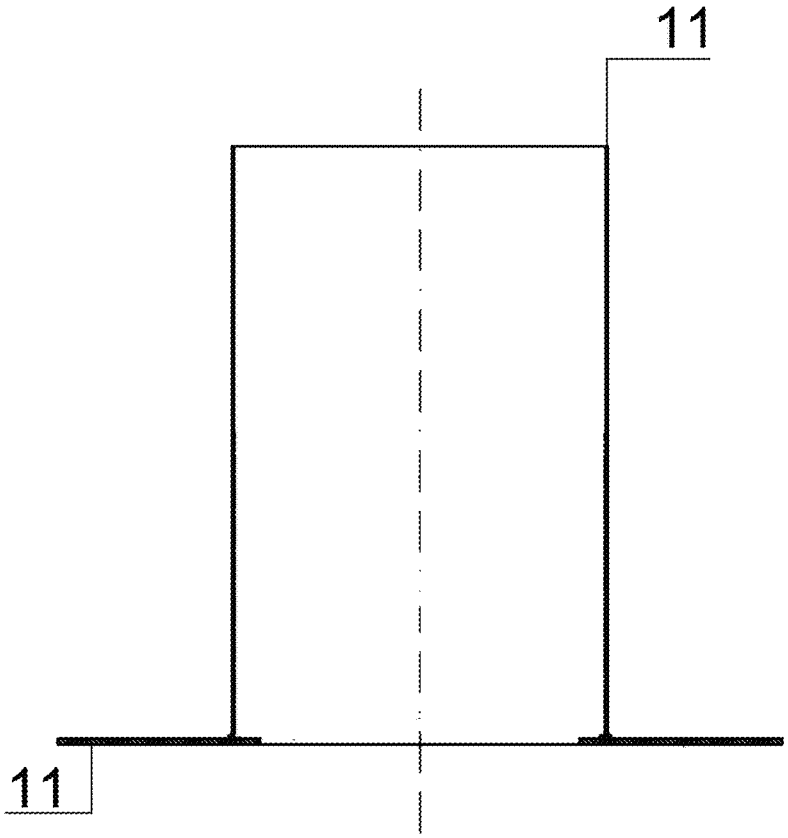

By referring to FIG. 14, the stabilizing member 200 comprises an outer jacket 11 apt to be housed in the central housing (2) and anchored with completion cast to the body of the slab upon the laying.

Advantageously, the housing 2 can provide a not smooth, knurled surface, so as to favour a better anchoring of the jacket 11.

Figure 15:
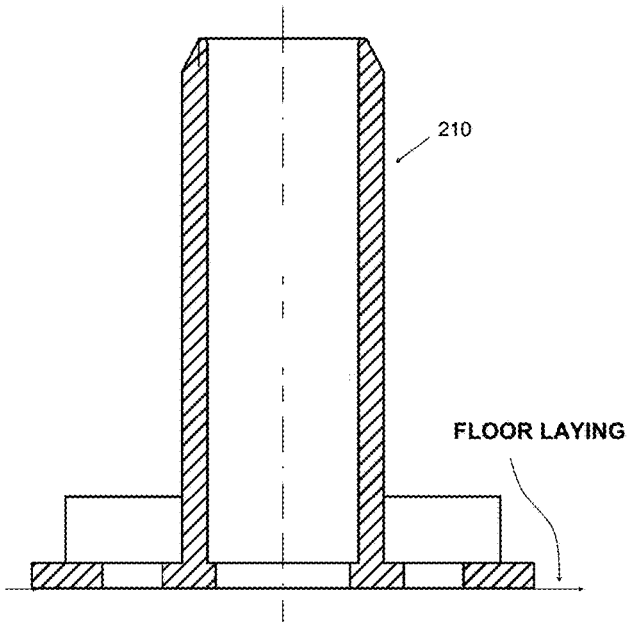
Figure 16:
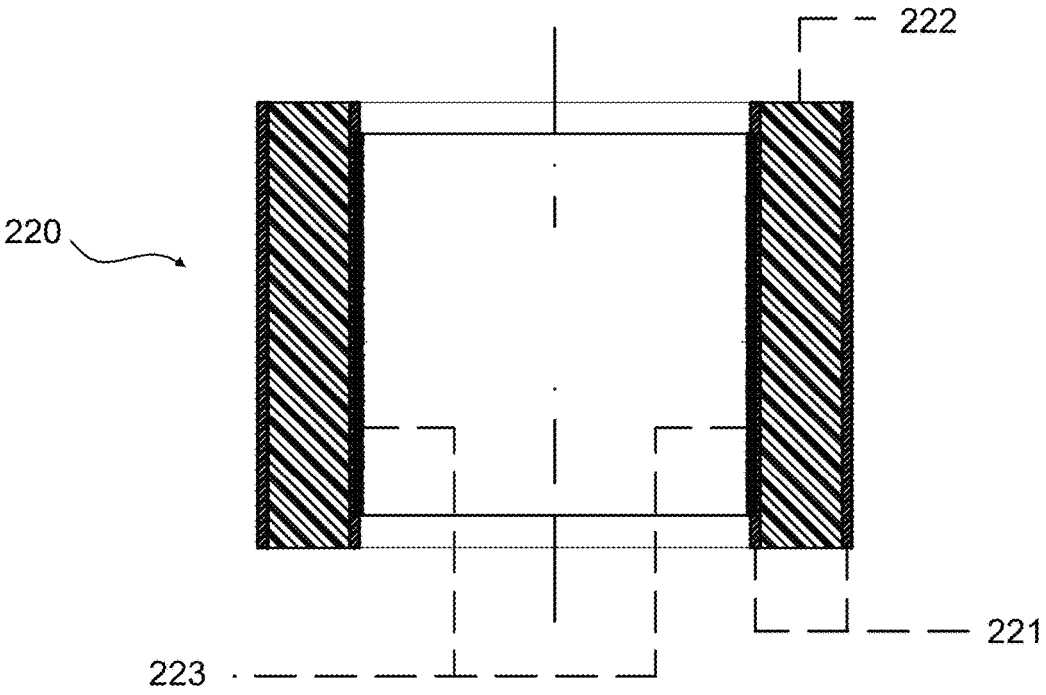

Furthermore, by referring to FIG. 15, the stabilizing member 200 comprises a stem 210, with tubular shape, apt to be fastened to the floor laying and a grazing deformable bearing 220, shaped like a rowing boat, apt to be interposed between the stem 210 and the jacket 11. The stem 210 can be fastened to the floor laying for example with four dowels (worked-out bars).

Figure 18:
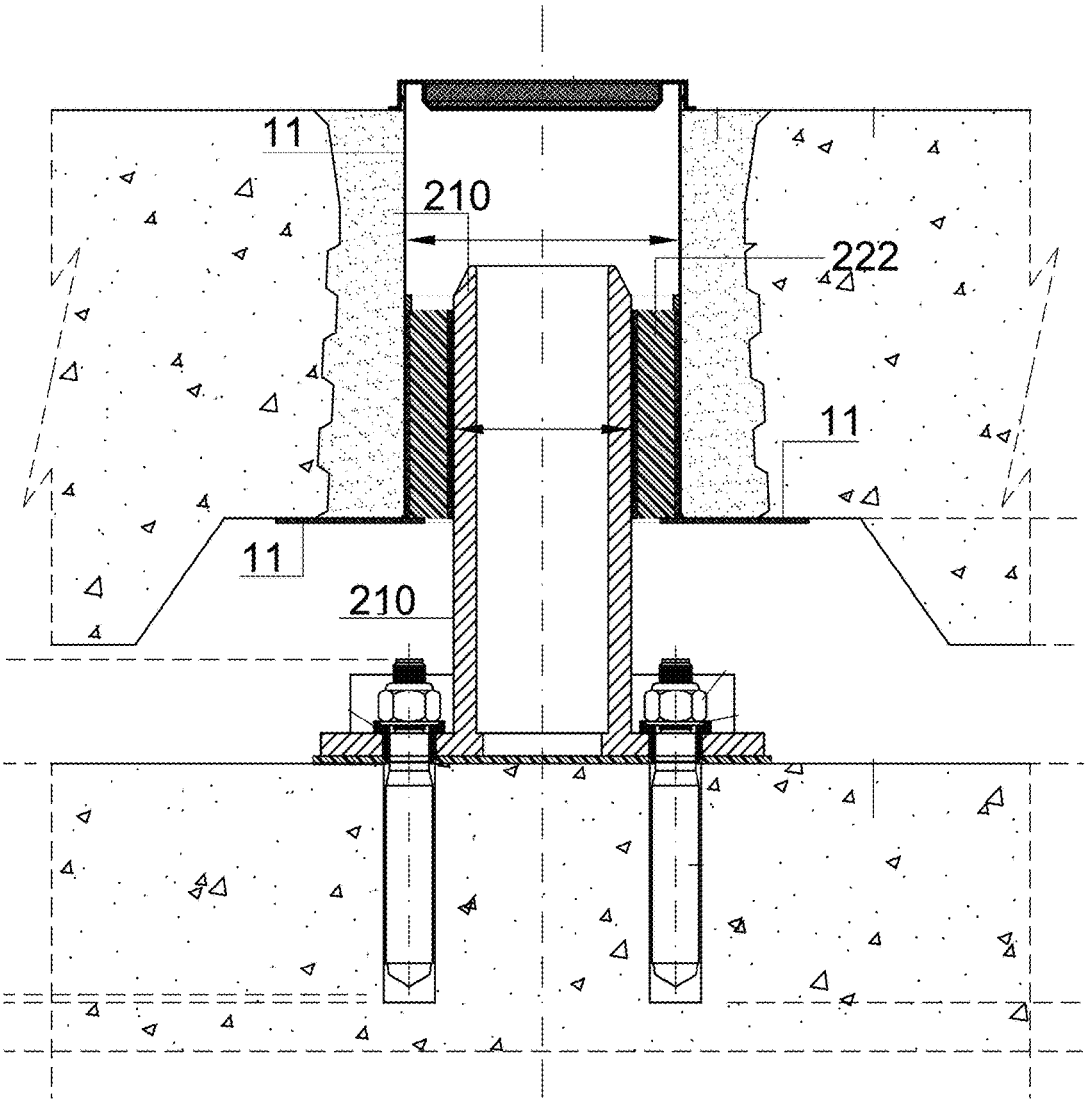

The subsequent FIGS. 17 and 18, show in section a stabilizing member 200 assembled for a slab 101.

Advantageously, the bearing 220 comprises an outer layer 221 made of steel, an intermediate layer 222 made of rubber and an inner layer 223 made of steel incorporating a bushing made of material with low friction coefficient, for example Teflon or an autolubricating sintered material, for example of the type used for grazing bearings.

The grazing deformable bearing 220 is then characterized by axial and cross stiffnesses with different entities calibrated for the specific application, in particular the axial stiffness (operating in vertical direction) is reduced and much smaller than the overall vertical stiffness of the existing elastomeric supporting members 122. Under conditions of correct operation such stiffness, moreover, is not moved since the bearing—in vertical direction—is grazing, that is it can slide in vertical direction with reduced friction coefficients.

On the contrary, the cross stiffness (operating horizontally, both in the rail direction and in orthogonal direction) decidedly is higher than the axial one but of the same order of overall vertical stiffness of the supporting members 122. In this way the fundamental dynamic features are of the same order of magnitude both for the vertical motions of the system and the cross and longitudinal ones.

In case it is requested that the stabilizing member 200 should be stiff in cross direction, that is not equipped with elasticity in the pseudo-horizontal plane, a bearing 200 could be provided, without the intermediate layer 222 made of rubber.

It is to be observed that the great advantage in the infrastructure layout of providing a central stabilizing member 200 with respect to the slab is to be observed, allowed by the use of two-locking sleepers with separated blocks.

The use of such stabilizing member 200—even if it keeps a manufactured product centrally with respect to the basin—allows having fundamental frequencies in the vertical plane and in the cross planes of the same order of magnitude by introducing an anti-vibrating filter effect not only in the vertical direction (component wherein the static and dynamic load are prevailing) but even in the cross and longitudinal directions (even if components wherein the static and dynamic loads are expected to be more reduced).

As already described the slab 101 comprises one or more pairs of housings with prismatic basin 3, implemented in extrados, apt to house respective rail-bearing blocks 30.

Figure 18A:
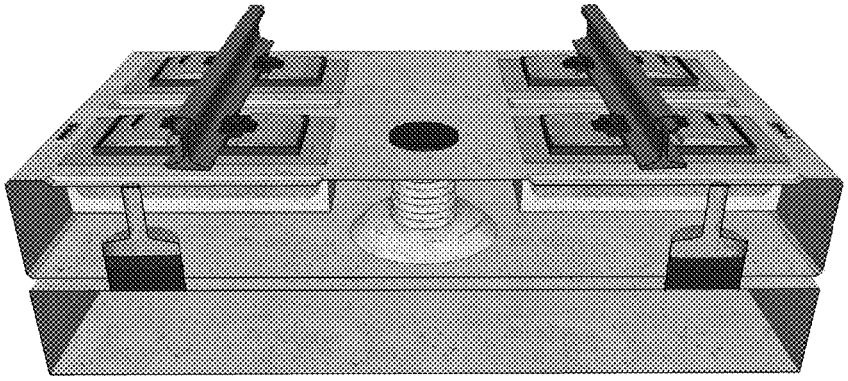
FIG. 18A shows, in section, a slab comprising both levelling members and a stabilizing member.

By way of example, FIG. 18A shows, in section, a slab comprising both levelling members and a stabilizing member.

Figure 19:
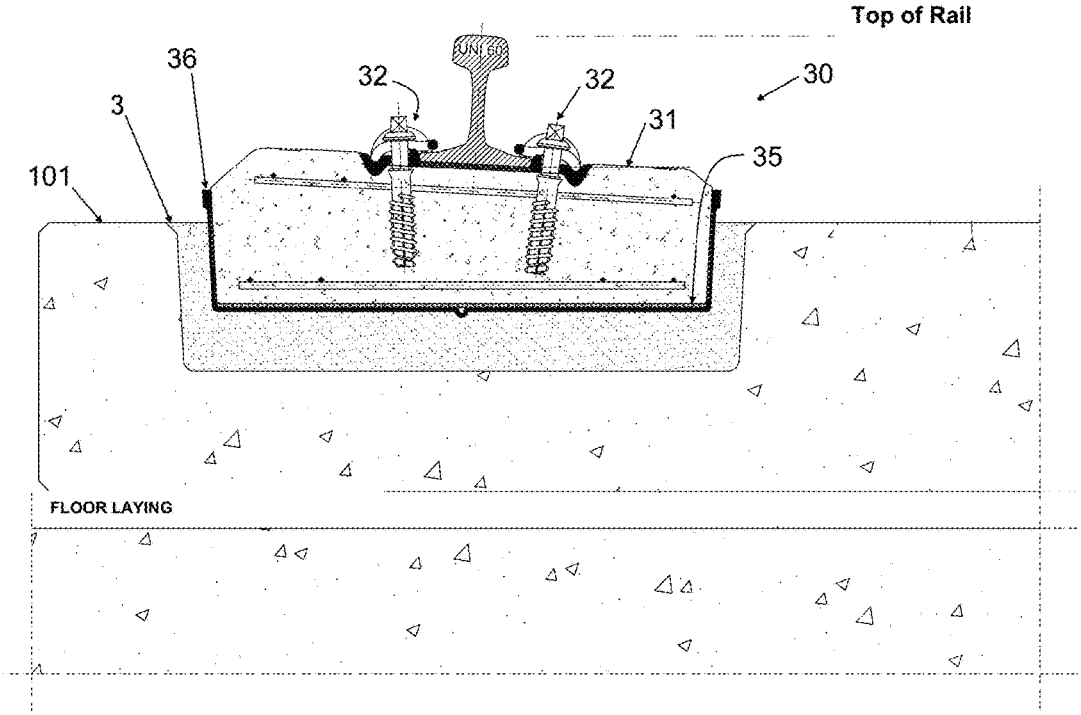
FIGS. 19 and 20 are views of a rail-bearing block according to the present invention.
Figure 20:
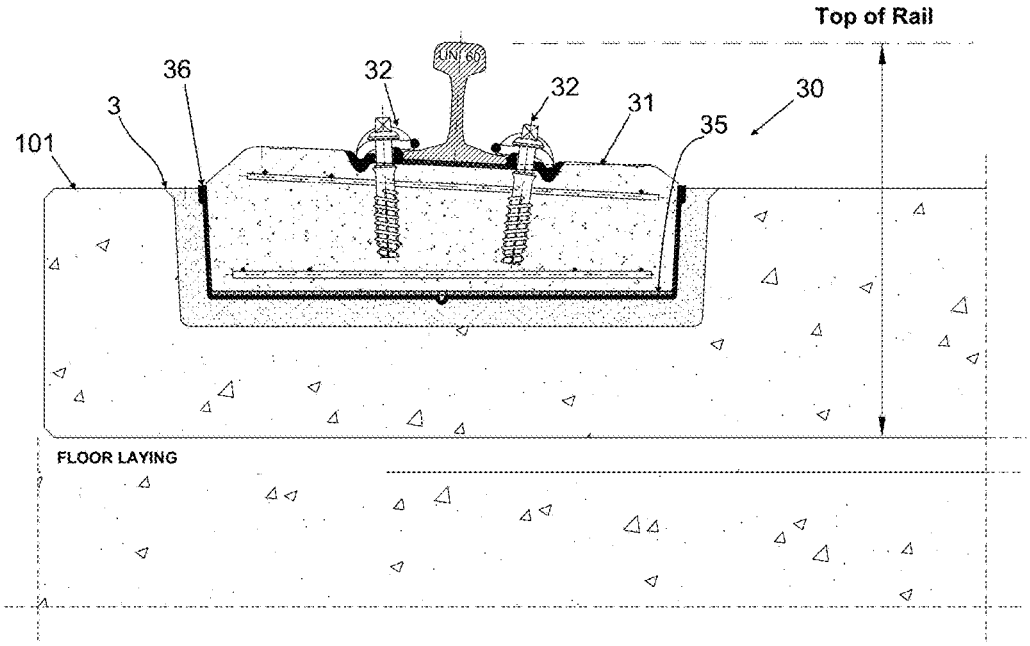
Figure 21:
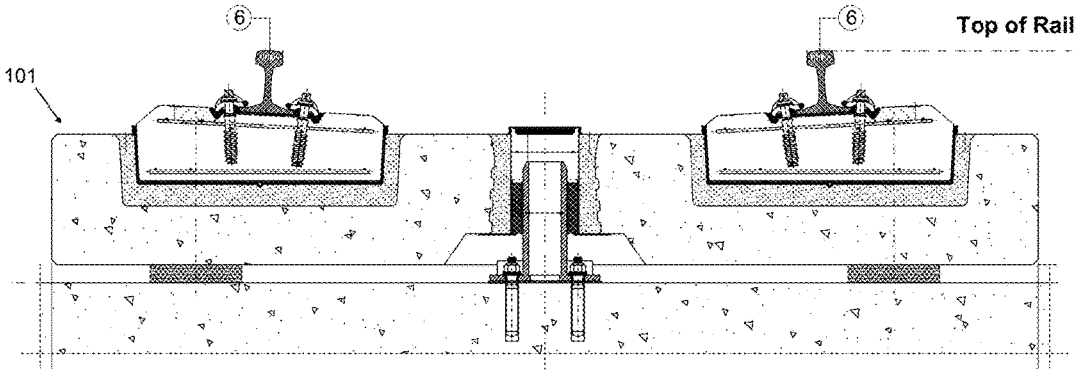
FIGS. 21 to 24 are section views illustrating the functionality of the system according to the present invention.
Figure 22:
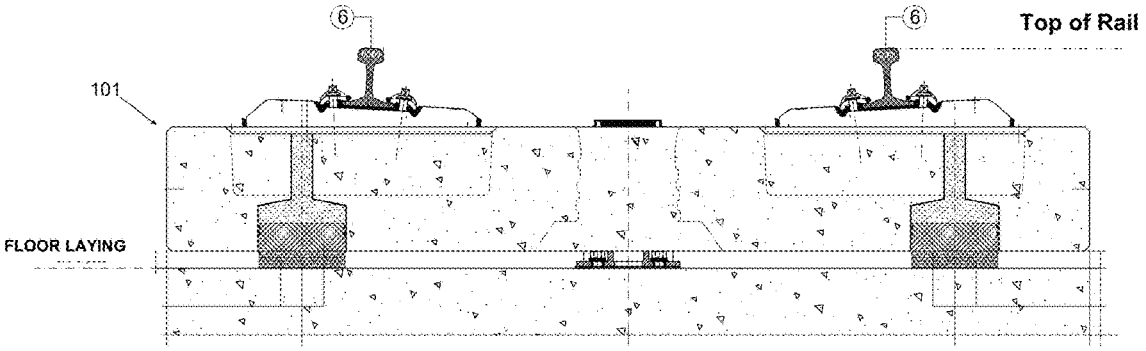
Figure 23:
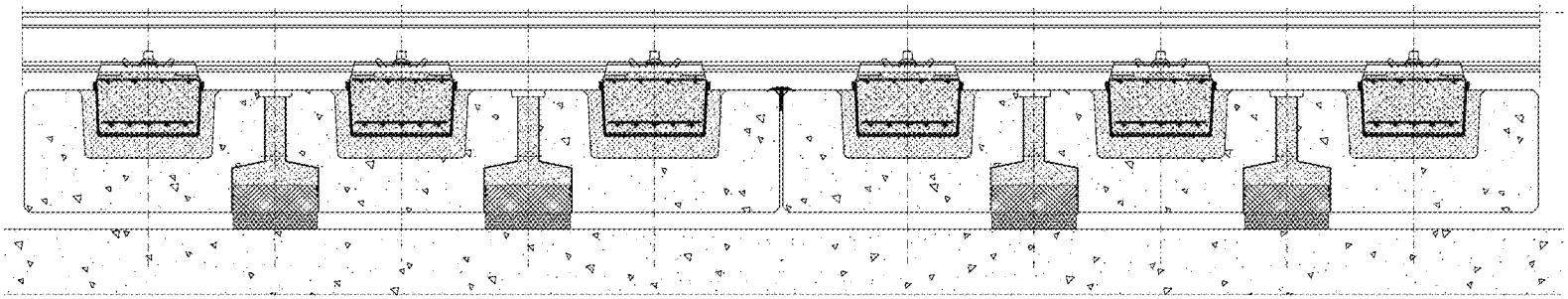

The subsequent FIGS. 19 and 20 show, in section, a housing with prismatic basin 3 wherein a corresponding rail-bearing block 30 is housed.

According to the present invention, a rail-bearing block 30 is a manufactured product having a main body 31 made of concrete with high concrete class.

Preferably, the manufactured product is cast in the caissons so that whereas the intrados and the side faces are smooth and made of concrete with metal caisson bottom, the intrados is smoothed with plaster trowel.

The main body 31 bears a fastening member 32 for a rail 6. The selection of the type of rails and of the fastening system thereof can take place in a wholly independent way without particular constraints, being able in this sense to consider the specific features of the line as to the uniformity of the equipment components installed along the railroad line.

By way of example, the fastening system types among the most commonly used ones are:

Railtech fastening system

Pandrol fastening system

Vossloh fastening system

It is then to be meant that the extrados could have a different shape depending upon the fastening type, apart from the presence of inserts for installing spikes or other specific manufactured products of the fastening system.

According to an embodiment of the present invention, each block 30 can include a bottom plate member 35 made of elastomer, placed at the base of the main body.

According to an embodiment each block 30 can further comprise a polymeric outer coating 36 made of rubber.

In particular the elastomeric members and made of rubber allow:

- a moderate deformability between the blocks 30 and the slab 101, which produces a
  <<filter>> effect for the highest frequencies (see elastomer 35);
- a simpler substitutability upon operation of the blocks 30 if the maintenance or operation needs require it (see manufactured product made of rubber 36).

To the purpose of the of the overall performances of the equipment the fastening system type of the rails produces a limited effect (thanks to the presence of the rail-pad elastomeric plate) since such performances substantially depend upon the elastomeric supporting members 122.

Each block 30 is drown in one of the basins 3 by means of bedding mortar, preferably after being equipped with a bottom elastomeric plate 35 and inserted in the polymeric coating boot 36 made of rubber.

The bedding mortar between the slab 101 and the blocks 30 is laid with the rails 6 already constrained on the blocks and correctly positioned with millimetric precision both as to the gauge and to the top of rail. The size of the compartments 3 of the basins is so as to allow an altimetric and planimetric adjustment of the blocks 30 di±20 mm. with respect to the ideal design conditions. Under the lowest laying condition of the block, however a space is left between the lower stretch of the rail and the extrados of the slab so as to allow easily the welding of the rails. In fact, generally in the equipment systems without ballast there are always interferences between the slab and the rails; these interferences are connected to the following operations:

- performing the welding of the rails for implementing the Continuous Welded Rail (CWR); a not much reduced gap between the extrados of the slab and the rail foot does not allow performing correctly the welding operations, by involving—as procedure of not conformity—the partial demolition (and subsequent restore) of the basin÷slab prefabricated in extrados.
- In the infrastructure plants often there is the need for laying electric cables, signalling cables, earthing bands, etc. which often have the need for passing below the foot of the rails; whereas under the condition of track on ballast this operation has no practical hindrance, under the condition of track without ballast, often this operation has hindrances connected to the reduced gap between the extrados of the basins÷slabs and the foot of the rails.

For these reasons, according to an embodiment, the slab 101 of a module according to the present invention can have at least a pair of grooves 4, implemented in extrados, transversally with respect to the direction of positioning the rails 6. Such grooves 4 allow the passage of possible cables below the rails, according to needs.

Furthermore, advantageously, it can be provided that between the extrados of the slab and the foot of the rail a minimum gap, not lower than 35 mm, can be kept. In reality, the gap, in association to the altimetric adjustment of the block results to be 55 mm±20 mm.

By making again reference to FIGS. 2 and 3, they show additional features which, according to some embodiments, can find place in a module according to the invention.

In particular, the supporting slab 101 can have one or more topographic feedback members 5 for positioning the slab itself.

These feedback members 5 for example are placed in extrados to the slab near the four vertexes. They are arranged in a well precise position (both in altimetric and planimetric terms) with respect to the top of rail in the standard configuration (meant without altimetric adjustments) and they are made of metal with feedbacks guaranteeing couplings with millimetric precision. In particular as to the altimetric position they find at a suitable height with respect to the top of rail depending upon the rail type and the fastening systems adopted in the standard configuration for the underground solution such height is 230 mm).

The feedback members are aimed at the two following aspects:

In case of assembling at works the blocks 30 and the slab, such feedbacks allow positioning with millimetric precision the template frame in metal frame for positioning the blocks 30 (in number of six or eight). In particular the template frame—implemented even by means of processings by processing machine—is equipped with feedbacks for the planar-altimetric positioning of the mentioned extractable blocks 30; the assembled template frame and blocks 30 then find the correct position with respect to the slab as the template frame is equipped with feedbacks matching exactly the four mentioned topographic feedbacks.

In the planar-altimetric topographic positioning along the layout of the specific slab, such feedbacks 5 allow positioning, with millimetric positioning, topographic references (optical ones or of other nature, for example GPS) which—based upon the layout design—provide topographic information about the planar-altimetric position rectifications of the slab necessary for a correct laying of the design manufactured product. That is the topographer—during installation—is able, automatically and surely, to provide the instruction necessary for a correct laying positioning of the slab.

Furthermore, according to additional embodiments, the supporting slab 101 can have one or more seats 9 passing from the extrados to the intrados, for inserting relative lifting jacks of the slab itself.

In particular, such seats 9 can comprise respective bushings (for example M36). Each bushing can be coupled to a tube passing in the thickness of the slab. These elements are aimed at the following two aspects:

By using four male eyebolts (for example M36) inserted in extrados to the slab it is possible hooking lifting ropes for moving the slab in the different production and installation phases (production at works, transportation, laying in the construction site, etc).

By using four threaded bars (for example M36) having an end rested on the floor laying and the other end screwn in the bushings it is possible performing the altimetric positioning of the slab—with millimetric precision—during the laying of the equipment system. In particular the bushings and the bars implement a real mechanical jack in the body of the slab, as the rotation of the threaded bar determines the raising or lowering of one of the four vertexes of the position rectangle of the bushings.

The base module of a system according to the invention, as described sofar, provides the use of two-block sleepers with separate rail-bearing blocks, in case equipped with boot made of rubber and elastomeric plate of block-pad and fastening system with one single spring level, as they constitute the most used scheme.

Figure 24:
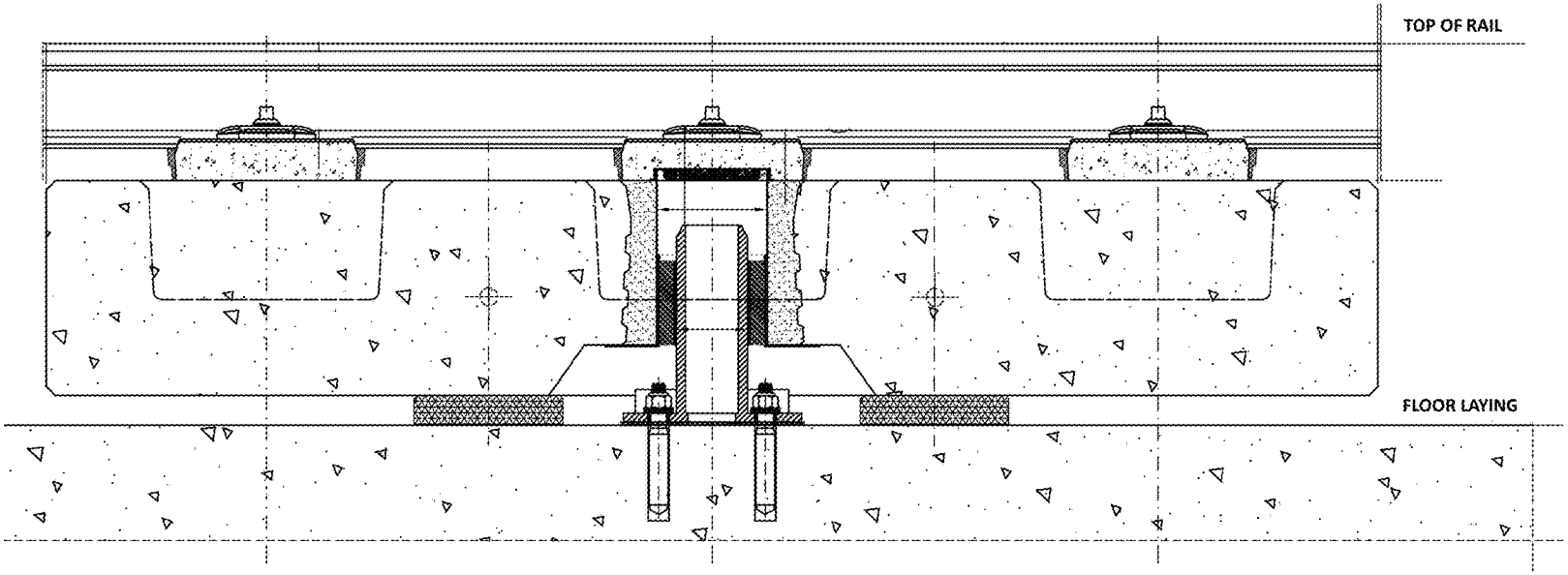
Figure 24A:
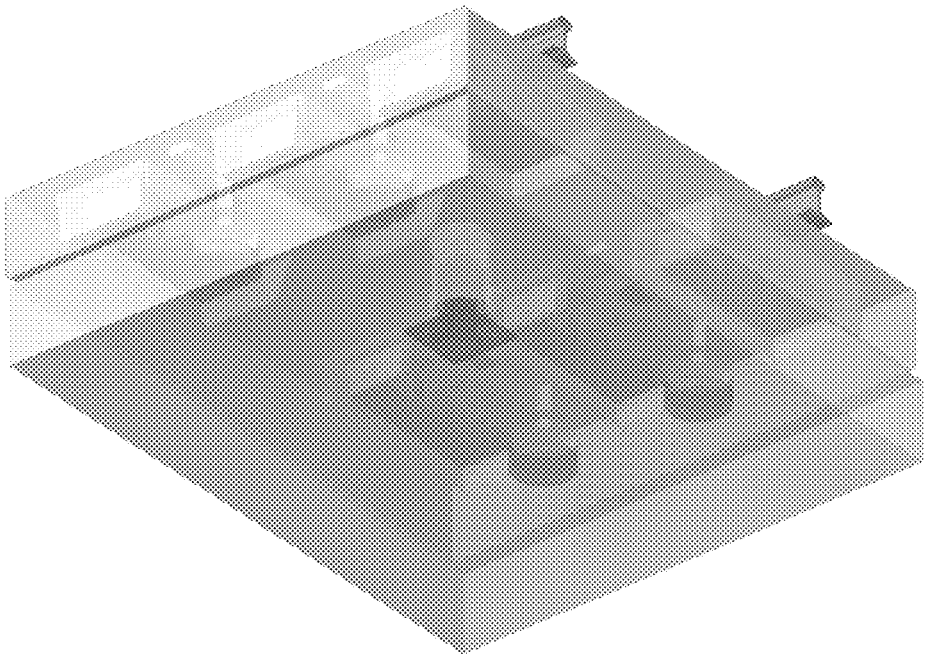
FIG. 24A is a bottom view, in transparency, with respect to the floor laying of a slab according to the present invention.
Figure 25A:
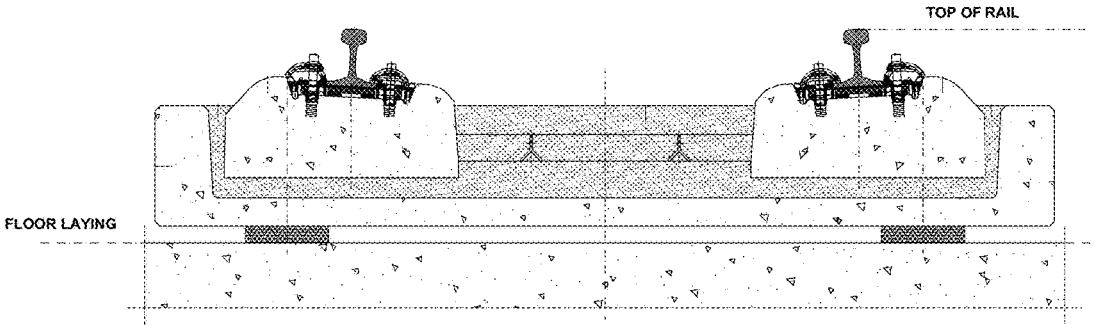
FIGS. 25A to 25G show possible alternatives for installing rail-bearing blocks and/or sleepers and/or fastening systems.
Figure 25B:
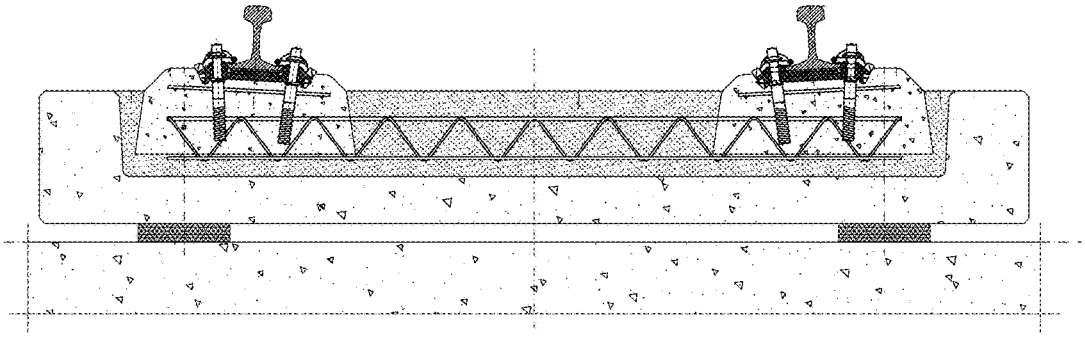
Figure 25C:
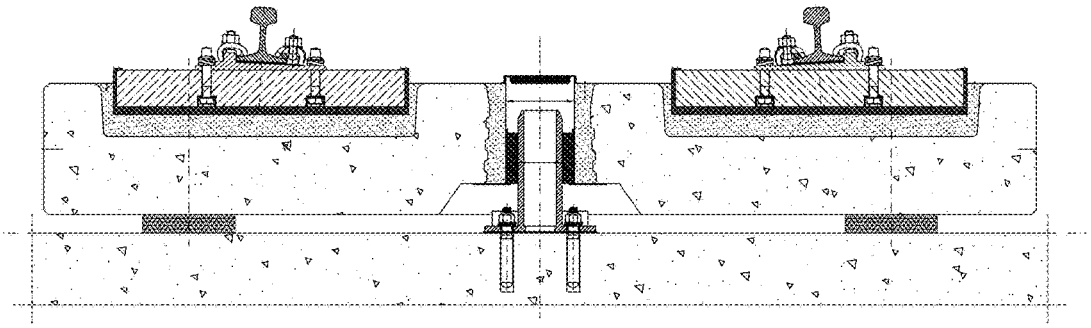
Figure 25D:
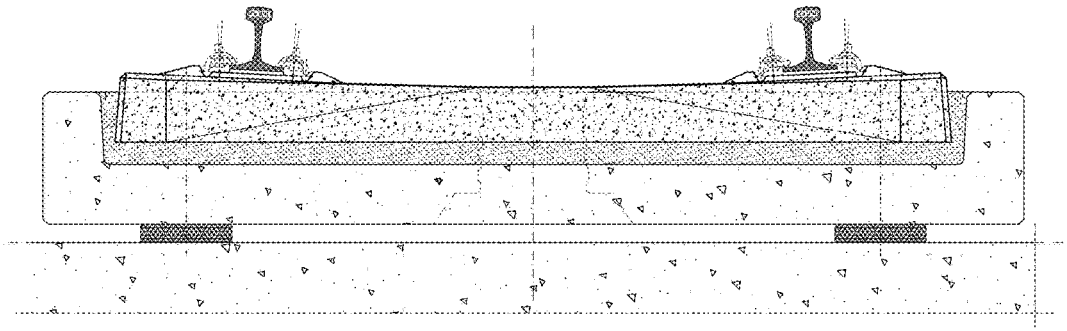
Figure 25E:
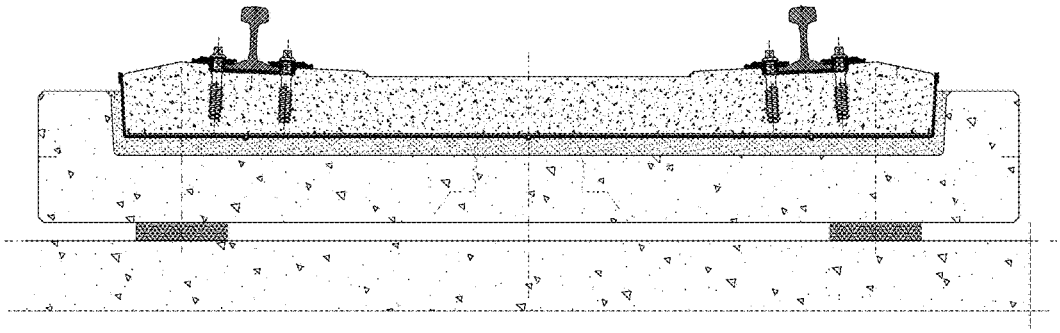
Figure 25F:
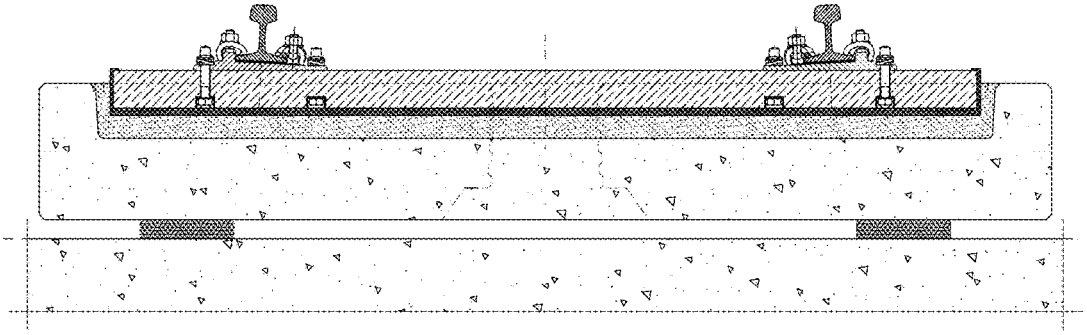
Figure 25G:
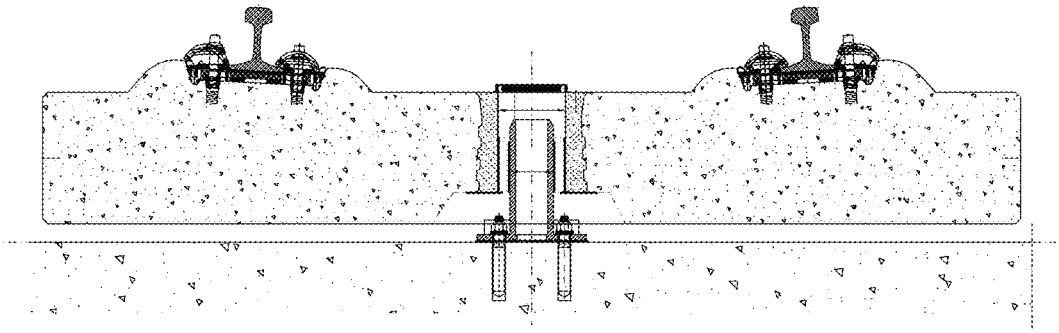

FIG. 24A is a bottom view, partially in transparency with respect to the floor laying, showing a slab according to the present invention.

However and with reference to FIGS. 25A to 25G, the system is suitable even to use the types of sleepers and fastening systems of the rail.

A first possible classification of the variants provides:

Use of two-block railroad sleepers.

Use of single-block railroad sleepers.

Figure 26A:
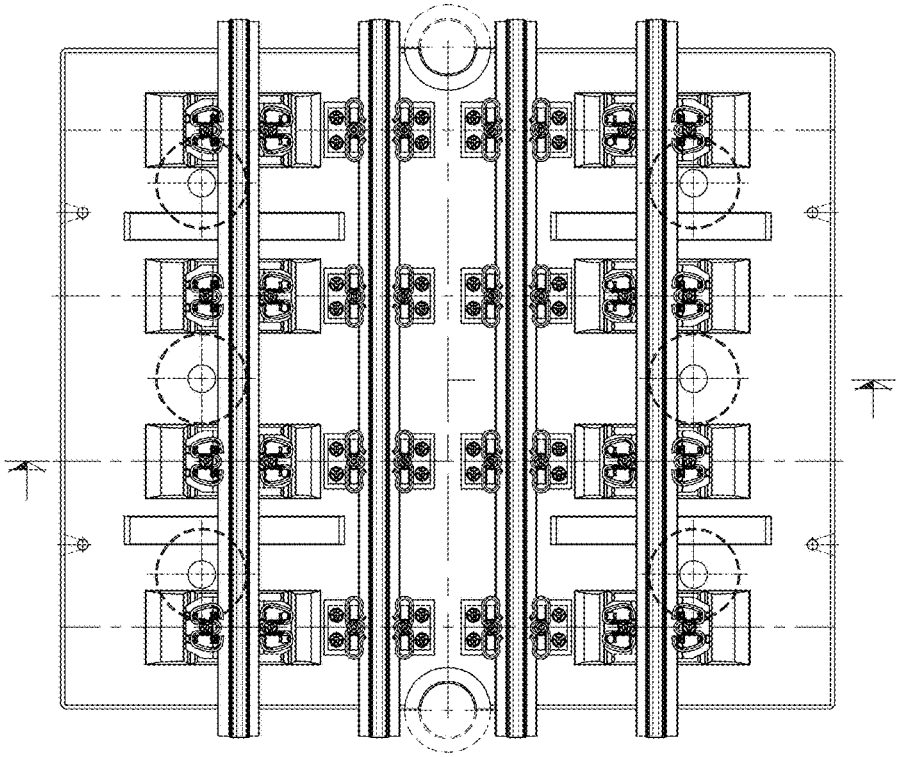
FIGS. 26A and 26B show, in plan, two possible embodiments of slab, with a different number and positioning of the levelling devices and of the stabilizing members.
Figure 26B:
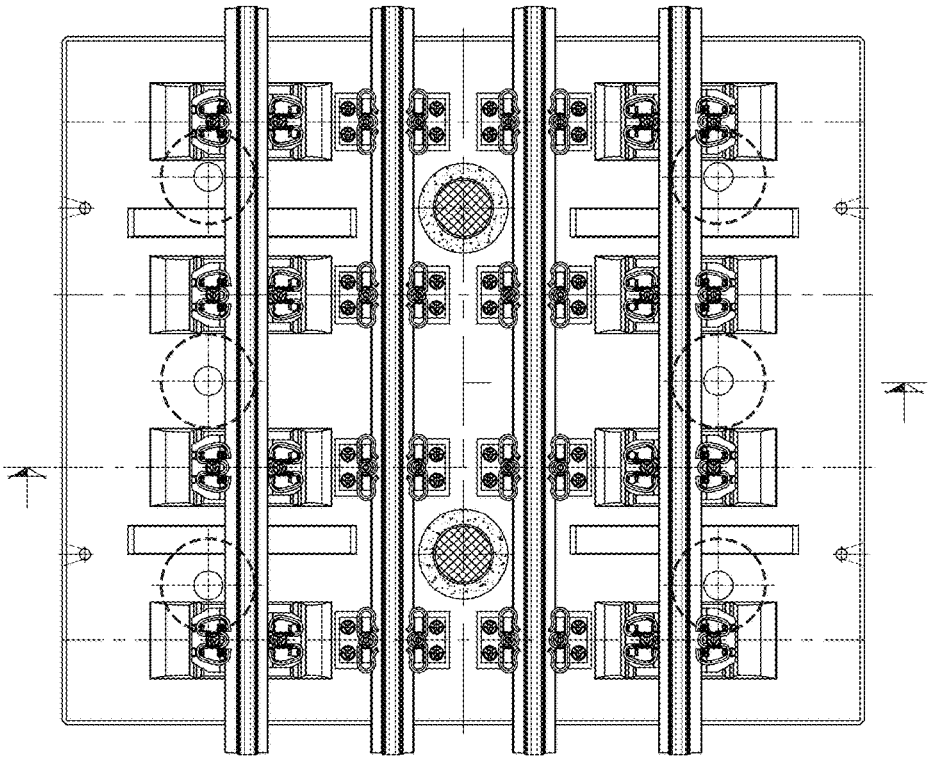
Figure 26C:
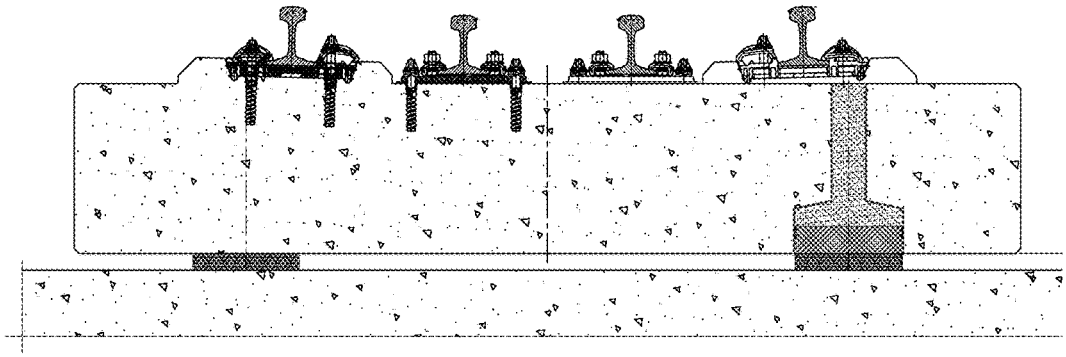
FIGS. 26C and 26D are section views of the slabs of FIGS. 26A and 26B, respectively.
Figure 26D:
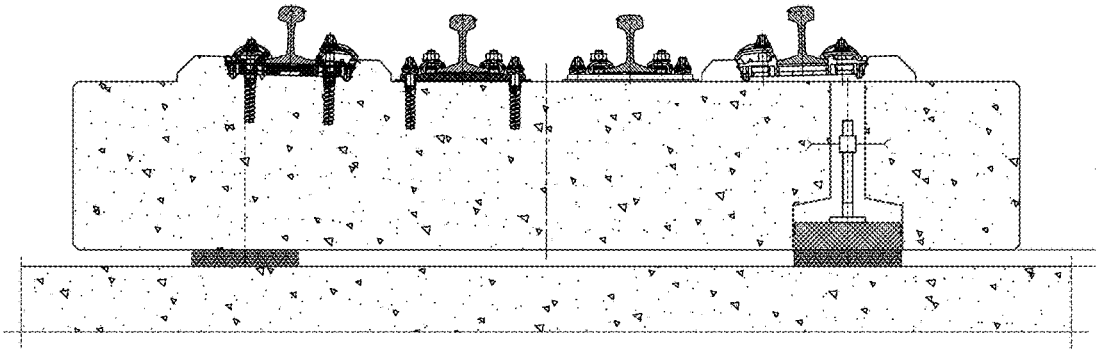

Absence of railroad sleepers, by providing shapes and inserts for installing the rail fastening system directly existing in the extrados to the prefabricated slab. Such solution often appears more compatible to the possible request both for inserting the crash safety inner rails, for example of the type illustrated in FIGS. 26A to 26C, and for laying rails/external bars for the power supply.

A second possible classification of the variants provides:

Railroad sleepers equipped with boots made of rubber and elastomeric plates of sleeper-pad and then viced with bedding mortar for the connection to the slabs.

Railroad sleepers directly viced to the slab, wherein once the installation is completed railroad sleepers and slab constitute a single body made of concrete.

A third possible classification of the variants provides:

Rail fastening system with simple spring level (presence of elastomeric rail-pad).

Rail fastening system with double spring level (presence both of elastomeric rail-pad and of equipment elastomeric plate-pad).

Rail fastening system without the possibility of rectifications for the position of the rail.

Rail fastening system with possibility of rectification even upon operation for the rail position, both in altimetric terms (top of rail), and in planimetric terms (gauge and axis-track position).

The railroad sleepers, especially in some of the illustrated variants, can be made of various materials, such as for example wood, plastic or metal.

The solutions provided according to such possible classifications, can even be combined therebetween depending upon the specific needs.

In particular it is observed that:

In case of absence of boot made of rubber and of elastomeric plate of sleeper-pad, the use of a fastening system with two spring levels appears preferable; the equipment elastomeric plate-pad and rail-pad provide the right elasticity of the fastening system, replacing the performances provided by the elastomeric plate of sleeper-pad (block-pad). This to guarantee an adequate dynamic response of the rails, by referring in particular to the value of the natural frequency of the rails or own secondary frequency (fr) characterizing the second resonance of the equipment system.

In case of absence of bedding mortar during laying, the use of fastening systems allowing altimetric and planimetric rectifications of the rail position appears preferable. This to allow to correct possible laying imperfections as well as possible corrections during the subsequent maintenance procedures.

Whereas some types of sleepers are suitable to used boots made of rubber and elastomeric plate of sleeper-pad, other types of sleepers are not such as to allow the use of boots made of rubber and elastomeric plate of sleeper-pad.

Hereinafter, some general considerations related to the design choices, to be considered preferred but not limitative, will be shown.

Use of Elastomers with Reduced Dynamic Stiffening

The system according to the invention has been developed by providing the use of elastomeric products prepared with mixtures with reduced mechanical stiffening (ratio between dynamic stiffness and static stiffness).

To this regard it is reminded that whereas for example the metal manufactured products (steel, aluminium, etc.) have wholly negligible dynamic stiffnesses, in case of elastomeric products usually there are not negligible dynamic stiffnesses which can reach even very high values (2.0÷3.0) [(kN/mm)/(kN/mm)].

In this way it has been possible finding a right compromise between the masses of the system and the stiffnesses of the elastomeric products existing in the track system, by observing the importance of using elastomeric products with reduced dynamic stiffening (1.2÷1.5) [(kN/mm)/(kN/mm)] as:

The settlements of the top of rail being equal more limited fundamental frequencies are obtained (fo and fr).

The fundamental frequencies being equal (fo and fr) more reduced settlements of the top of rail are expected.

Actually—once having fixed some limits to the settlements of the top of rail, the use of elastomers with reduced dynamic stiffening allows reducing the system mass, which involves in particular the reduction in the overall dimensions of the equipment system and of the geometrical sizes and the weight of the slabs.

Independent Choice of the Features of the Elastomeric Materials

The choice of the features of the elastomeric materials is important for controlling the equipment dynamic behaviour which has two fundamental involvements—in performance terms—:

Effectiveness of the anti-vibrating insulation filter effect of the floating system, determined by the natural frequency of the floating system or primary natural frequency (fo)

Containment of the potential formation of moiré effects on the rolling plane of the track due to dynamic micro-slidings wheel÷rail connected to the dynamic interaction equipment÷vehicle, determined by the natural frequency of the rails (fr)

By fixing as goals:

natural frequency of the floating system or own primary frequency (for example fo<20÷22 Hz)

natural frequency of the rails (for example fr≈100÷120 Hz)

The features of the elastomeric products are then chosen independently:

For the elastomeric body of the supporting members 122, for controlling the value of the natural frequency of the floating system or primary natural system (fo)

For the features of the elastomeric plates of block-pads, for controlling the value of the natural frequency of the rails (fr)

The system has been developed by optimizing the features of the elastomeric components present in the system by choosing in particular mixtures characterized by a reduced dynamic stiffening.

It is well known that any elastomeric product has more limited static stiffnesses (mobilized by load applied slowly) than the dynamic stiffnesses (mobilized by loads applied in a quick way):

Whereas for example the metal manufactured products (steel, aluminium, etc.) have values near the unit (that is negligible dynamic stiffenings), in case of elastomeric product there are dynamic stiffenings which can reach even very high values (2.0÷3.0) [(kN/mm)/(kN/mm)] (that is absolutely not negligible dynamic stiffenings in design and performance terms of the equipment systems).

It is necessary observing that whereas the static behaviours of the elastomeric manufactured products determines the equipment response to the (almost-static) gravitational loads moving along the track, the dynamic behaviour of the elastomeric manufactured products determines the equipment response to the dynamic loads.

In substance, whereas the settlements of the top of rail are determined by the static behaviour of the elastomeric manufactured products (mobilized the static stiffness), the natural frequencies of the system are determined by the dynamic behaviour of the elastomeric manufactured products (mobilized the dynamic stiffness).

It is to be reminded that the equipment dynamic behaviour is characterized by two main frequencies; in particular:

Dynamic response of the floating system

Substantially characterized by the mass of the slabs and by the elasticity of the elastomeric manufactured products existing in the component made of elastomer÷PVC/PE of the levelling devices. The most significative parameter is the natural frequency of the floating system or primary natural frequency (fo) characterizing the anti-vibrating filtering effect of the floating system.

Dynamic response of the rails

Substantially characterized by the mass of rails and the rail-bearing extractable blocks and by the elasticity of the elastomeric manufactured products of block-pad.

The most significative parameter is the natural frequency of the rails or secondary natural frequency (fr) characterizing the second resonance of the equipment system.

Several studies lead back to the value of this dynamic parameter (fr), the evaluation of the potential formation of moiré effects on the track rolling plane due to dynamic micro-slidings wheel÷rail connected to the dynamic interaction equipment÷vehicle. When the natural frequency of the rails (fr) places in the field of the natural frequencies in the rooms of the vehicles of the underground/railroad trains, potentially important moiré phenomena are expected.

The planning of the anti-vibrating equipment systems is based upon the detection of the right balance between the elasticity of the elastomeric components and the masses existing in the track system, by considering both the "dynamic performances" and the "static performances".

In fact whereas the "dynamic performances" (values of the fundamental frequencies fo and fr) of the system improve the more the products are highly deformable, the "static performances" (see the settlements of the top of rail) of the system improve the more the products are stiff.

Therefore—in relation to what just illustrated—it appears important to use elastomeric products with limited dynamic stiffening (1.25÷1.50) [(kN/mm)/(kN/mm)] as:

The settlements of the top of rail being equal, more limited fundamental frequencies (fo and fr) are obtained.

The fundamental frequencies (fo and fr) being equal, reduced settlements of the top of rail are expected.

Hereinafter, by way of example, the modes for laying a system according to the present invention will be described, which then comprises a plurality of modules of the type described sofar.

Such description will still help in the comprehension of the system, of its components and the design choices to be performed.

The preferred laying procedure is the following:

A) Based upon the design of the railroad layout, tracing the positions of the slabs and the positions of the stabilizing members on the floor laying;

B) Altimetric topographic checks of the heights with respect to the layout design; the following situations might happen:

B.1) The construction tolerances of ±30 mm (frequent) are met. In this case it is possible using the only adjustment provided in the laying of the slabs, by making the slabs to come to the construction site already equipped with the six (eight) extractable blocks in the medium position (distance between top of rail and intrados of the slab equal to 590 mm for the underground solution).

B.2) The construction tolerances of ±30 mm are not met, however the construction tolerances of ±50 mm are met (possibly but rarely expected). In this case it is preferable using both the adjustment provided in the laying of slabs, and in the laying of the rail-bearing blocks, by making the slabs and six (eight) blocks for each module inserted in the housing compartments existing in the slabs to come to the construction site separately.

B.3) The construction tolerances of ±50 mm are not met (not expected, even if however possibly but very rarely). In this case it is preferable providing a not conformity procedure of the floor laying, providing—depending from the cases—thickenings of floor laying (to raise the height of the floor laying), or demolitions/millings (to lower the height of the floor laying).

C) Installation of the stabilizing members: vertical core drillings in the floor laying for the seats of the worked-out bars, laying of the same, positioning of the complete manufactured product and clamping of the worked-out bars.

D) Positioning of the equipped slabs in the intrados of the levelling devices kept in position by the annular seals existing in the portion made of PVC/PE of the sliding members of the levelling devices.

E) Planimetric millimetric adjustment (transversal, longitudinal and rotation around the vertical axis) of the equipped slabs in extrados of the topographic feedback members at suitable height from the top of rail. The procedure is performed by acting with horizontal mechanical adjusting jacks, which find easy feedback upon laying on the same infrastructure.

F) Altimetric millimetric adjustment of the equipped slabs in extrados of the topographic feedback members at suitable height from the top of rail. The procedure is performed by acting with the jacks implemented with the bars inserted into the bushings existing in extrados of the slabs.

G) By acting in extrados it is provided:

G.1) Position of the levelling devices the deformable intrados thereof must be pushed in contact with the floor laying; such procedure is to be performed, by acting in extrados to the basin÷slab, with a rod inserted in the vertical hole; the operator has to push with force until the contact of the levelling device with the floor laying. Alternatively, the jacks implemented with bars and bushings, could be installed in the portion to the extrados of the same levelling devices and then the altimetric adjustment would take place by acting directly thereon.

G.2) Laying cast of the finishing (bedding) mortar, by acting in extrados to the slab, by clogging the containment niches of the levelling devices.

G.3) Laying cast of the finishing (bedding) mortar, by acting in extrados to the slab, by clogging the containment niches of the stabilizing member (if existing).

G.4) Subsequently to the phase of hardening the bedding mortar, disassembly/recovery of the bars and the jacks. In case of FIG. 26C the levelling bars are disposable as incorporated in the bedding mortar, however they are convenient with respect to the other solutions as it is not necessary to wait for the mortar setting as the slab remains supported by the bars themselves. Such solution can be applied to all railroad/tram lines.

H) Installation of the rails and the fastening systems.

I) In the case B.1) one passes directly to the item M) [by jumping the items J), K) e L)].

In the case B.2) one proceeds with the subsequent item J).

J) Planar-altimetric millimetric adjustment of the rails (and of the rail-bearing block) by acting with mechanical vertical/horizontal jacks and adjusting templates which can be easily installed on the extrados of the slabs.

K) Laying cast of the finishing (bedding and grouting) mortar, by acting in extrados to the slab, by clogging the containment niches of the rail-bearing blocks.

L) Subsequently to the phase of hardening the bedding mortar, disassembly/recovery of the vertical/horizontal jacks and adjusting templates for laying the rail-bearing blocks.

M) Topographic check with millimetric precision of the track geometry, with respect to the layout of the design track.

N) At last, possible laying imperfections of the top of rail (not expected in theoretical terms) can be subsequently corrected in case of slabs equipped with fastening systems adjustable in altimetric and planimetric sense.

From what described sofar, the evident advantages can be obtained in terms of laying flexibility and simplicity.

In particular, one of the most relevant aspects appears to be that of having inserted an additional level of altimetric adjustment of the top of rail.

In fact, to the adjusting level related to the laying of the rail-bearing block (see the finishing mortar for bedding and grouting between slab and block), a second adjusting level has been added related to the laying of the slab (see the finishing mortar due to clogging between levelling devices and slab).

In summary, then, according to the embodiment, the following altimetric adjustments can be provided:

Slab level—altimetric adjustment of ±30 mm

Rail-bearing block level—altimetric adjustment of ±20 mm

Total altimetric adjustment of ±50 mm.

The laying strategies are then two:

In case the construction tolerances are included in the limit±30 mm, one provides using the only slab adjusting level, by sending to the construction site the slab already equipped at works/prefabrication factory with six (eight) blocks.

In case the construction tolerances of ±30 mm are not met, but however the construction tolerances are included in the limit±50 mm, one provides using both the slab adjusting level and the rail-bearing block adjusting level.

The invention is important if one considers that the existing equipment solutions are able to allow adjustments lower than ±20 mm; the carrying out of the floor laying is civil work by building company which finds difficult to guarantee precisions lower than ±20 mm, with consequent presence of a high number of not conformity along the layout to be repaired with not negligible costs and time; the carrying out of the floor laying with higher precisions (from ±30 mm to ±50 mm) has not great difficulties, with consequent presence of a really reduced number of not conformity along the layout to be repaired; by excluding for a high number of situations (case of tolerances of the floor laying lower than ±30 mm) bedding interventions of the laying rail-bearing blocks have positive influences on construction time and costs, in fact keying, grouting and bedding at works of the blocks have important operating advantages.

The present invention has been so far described by referring to preferred embodiments thereof. It is to be meant that each one of the technical solutions implemented in the preferred embodiments herein described by way of example, could be combined advantageously differently therebetween, to create other embodiments belonging to the same inventive core and however within the protection scope of the here below reported claims.

What is claimed is:

1. A module of a system for laying railroad and tram lines, comprising:

a supporting slab having a substantially parallelepiped shape, the supporting slab having an upper surface and a lower surface; and adjustable levelling devices;

wherein the supporting slab includes at least four peripheral housings, passing from the upper surface to the lower surface of the supporting slab, having closed lateral walls within the supporting slab, for housing the respective adjustable levelling devices, each one of the peripheral housings having a portion at the lower surface with a prismatic shape having a first base area and a portion at the upper surface having a second base area, the second base area being smaller than the first base area, each one of the peripheral housings having a jacket;

wherein each levelling device slides within the jacket at the portion at the lower surface of a corresponding peripheral housing; and wherein a bedding mortar is filled within the portion at the upper surface of each peripheral housing for clogging the peripheral housing upon the corresponding levelling device.

2. The module according to claim 1, wherein the jacket is made of PVC/PE.

3. The module according to claim 1, wherein each leveling device has a sliding member and a supporting member, overlapped therebetween.

4. The module according to claim 3, wherein the sliding member is made of PVC/PE and the supporting member is made of elastomeric material.

5. The module according to claim 1, further comprising two or more rail-bearing blocks, each rail-bearing block having a main body, a fastening member for fastening a rail to the main body, and a bottom plate member at a base of the main body.

6. The module according to claim 5, wherein the main body is made of concrete and the bottom plate member is made of elastomer.

7. The module according to claim 5, wherein each rail-bearing block further has a polymeric outer coating made of rubber.

8. The module according to claim 5, wherein the supporting slab further includes at least a pair of housings at the upper surface, each housing having a basin for housing a respective rail-bearing block.

9. The module according to claim 8, wherein the supporting slab includes three or four pairs of housings with a prismatic basin depending upon a distance value of resting members of a rail.

10. The module according to claim 1, further comprising a stabilizing member for stabilizing the supporting slab.

11. The module according to claim 10, wherein the supporting slab further includes a central housing, passing from the upper surface to the lower surface, for receiving the stabilizing member.

12. The module according to claim 10, wherein the stabilizing member has an outer jacket to be housed in the central housing, a tubular stem to be fastened to a ground and a deformable bearing interposed between the tubular stem and the outer jacket.

13. The module according to claim 12, wherein said bearing has an outer layer made of steel, an intermediate layer made of rubber and an inner layer made of steel incorporating a bushing made of a material with low friction coefficient.

14. The module according to claim 1, wherein the supporting slab further includes at least a pair of grooves at the upper surface, traverse with respect to a positioning direction of rails.

15. The module according to claim 1, wherein the supporting slab further includes one or more topographic feedback members for positioning the supporting slab.

16. The module according to claim 1, wherein said supporting slab further includes one or more seats passing from the upper surface to the lower surface, for inserting related jacks for lifting the supporting slab.

17. A system for laying railroad and tram lines, comprising a plurality of modules, each module including:

a supporting slab having a substantially parallelepiped shape, the supporting slab having an upper surface and a lower surface; and adjustable levelling devices;

wherein the supporting slab includes at least four peripheral housings, passing from the upper surface to the lower surface of the supporting slab, having closed lateral walls within the supporting slab, for housing the respective adjustable levelling devices, each one of the peripheral housings having a portion at the lower surface with a prismatic shape having a first base area and a portion at the upper surface having a second base area, the second base area being smaller than the first base area, each one of the peripheral housings having a jacket;

wherein each levelling device slides within the jacket at the portion at the lower surface of a corresponding peripheral housing; and wherein a bedding mortar is filled within the portion at the upper surface of each peripheral housing for clogging the peripheral housing upon the corresponding levelling device.

18. A method for laying a module, comprising:

providing a module including:

a supporting slab having a substantially parallelepiped shape, the supporting slab having an upper surface and a lower surface; and adjustable levelling devices;

wherein the supporting slab includes at least four peripheral housings, passing from the upper surface to the lower surface of the supporting slab, having closed lateral walls within the supporting slab, for housing the respective adjustable levelling devices, each one of the peripheral housings having a portion at the lower surface with a prismatic shape having a first base area and a portion at the upper surface having a second base area, the second base area being smaller than the first base area, each one of the peripheral housings having a jacket;

wherein each levelling device slides within the jacket at the portion at the lower surface of a corresponding peripheral housing; and wherein a bedding mortar is filled within the portion at the upper surface of each peripheral housing for clogging the peripheral housing upon the corresponding levelling device;

positioning the module on a ground;

performing an altimetric adjustment of the supporting slab;

positioning the levelling devices such that supporting members of the levelling devices are pushed in contact with the ground; and filling the bedding mortar within the portion at the upper surface of each peripheral housing for clogging the peripheral housing upon the corresponding levelling device.

* * * * *